US011161171B2

(12) United States Patent
Takahashi

(10) Patent No.: US 11,161,171 B2
(45) **Date of Patent: *Nov. 2, 2021**

(54) MOLTEN METAL STIRRING DEVICE AND CONTINUOUS CASTING DEVICE SYSTEM PROVIDED WITH SAME

(71) Applicant: Kenzo Takahashi, Shiroi (JP)

(72) Inventor: Kenzo Takahashi, Shiroi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/027,749

(22) Filed: Sep. 22, 2020

(65) Prior Publication Data

US 2021/0001395 A1 Jan. 7, 2021

Related U.S. Application Data

(63) Continuation of application No. 16/604,049, filed as application No. PCT/JP2018/015286 on Apr. 11, 2018, now Pat. No. 10,814,379.

(30) Foreign Application Priority Data

Apr. 13, 2017 (JP) ..... 2017-080057
Apr. 4, 2018 (JP) ..... 2018-072699

(51) Int. Cl.
*B22D 11/115* (2006.01)

(52) U.S. Cl.
CPC ..... *B22D 11/115* (2013.01)

(58) Field of Classification Search
CPC ..... B22D 11/115; B22D 11/18; B22D 11/205
See application file for complete search history.

(56) References Cited

U.S. PATENT DOCUMENTS 4,478,273 A * 10/1984 Hanas ..... B22D 11/115 164/468
2006/0133194 A1 6/2006 Takahashi
2014/0079561 A1 3/2014 Takahashi

FOREIGN PATENT DOCUMENTS

JP 2006-189229 A 7/2006
JP 2011-237056 A 11/2011
JP 2014-35131 A 2/2014

OTHER PUBLICATIONS

Extended European Search Report dated Mar. 19, 2020 in Patent Application No. 18784252.1, 4 pages.
International Search Report dated Jun. 26, 2018 in PCT/JP2018/015286 filed on Apr. 11, 2018.

* cited by examiner

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

In continuous casting, to provide products with excellent quality with high productivity. A molten metal from a melting furnace is stirred and driven by a Lorentz force due to crossing of magnetic lines of force from a magnet and direct current and sent to a mold while improving the quality of the molten metal, or a molten metal immediately before solidification in the mold by the Lorentz force to equalize the temperature of the molten metal immediately before solidification in the mold. As a result, finally a high quality product can be obtained, and the performance of the magnet can be maintained by cooling the magnet.

18 Claims, 28 Drawing Sheets

MOLTEN METAL STIRRING DEVICE AND CONTINUOUS CASTING DEVICE SYSTEM PROVIDED WITH SAME

CROSS-REFERENCE TO RELATED APPLICATIONS

This application is a continuation of and claims the benefit of priority under 35 U.S.C. § 120 of U.S. application Ser. No. 16/604,049, filed Oct. 9, 2019, which is a U.S. national stage application of PCT/JP2018/015286, filed Apr. 11, 2018, and claims the benefit of priority under 35 U.S.C. § 119 of Japanese Application No. 2018-072699, filed Apr. 4, 2018 and Japanese Application No. 2017-080057, filed Apr. 13, 2017, the entire contents of each of which are incorporated herein by reference.

TECHNICAL FIELD

The present invention relates to a molten metal stirring device and a continuous casting device system provided with the molten metal stirring device.

BACKGROUND ART

Conventionally, a product (round bar ingot and the like) is obtained by continuously casting a molten metal having conductivity, that is, a non-ferrous metal melt or a melt of metal other than non-ferrous metal (for example, Al, Cu, Zn or Si, or an alloy of at least two of them, or Mg alloy, etc.).

In the continuous casting, for example, it has generally been adopted that a molten metal is introduced from a melting furnace by a crucible and poured into a mold.

However, only the present inventors independently have the following view with respect to the conventional manufacturing method.

That is, first, when a molten metal is poured into a mold, the molten metal drops in the air and entraps air. For this reason, it is inevitable that the quality of a product is degraded.

Furthermore, when a product obtained from a mold is large (particularly when a cross-sectional area is large), the cooling rate of a molten metal greatly differs between a peripheral portion and a central portion of the product. That is, while the molten metal is cooled rapidly in the peripheral portion of the product, it is cooled more slowly in the central portion than that in the peripheral portion. This results in significant differences in the crystallographic structure of the metal in the peripheral and central portions of the product. This inevitably leads to a significant loss of the mechanical properties of the product.

SUMMARY OF INVENTION

Technical Problem

Conventionally, persons skilled in the art other than the present inventors have not particularly had great dissatisfaction or problems in product quality and production efficiency. Therefore, persons skilled in the art other than the present inventors did not have the problem that they had to make improvements on the manufacturing device and the manufacturing method in terms of product quality and production efficiency. However, as described above, only the present inventors among the persons skilled in the art have had a sense of problems (issues) unique to the inventors as described above. That is, the inventors have had a problem that as an engineer, it is necessary to provide a better product with higher efficiency than now.

Solution to Problem

A molten metal stirring device according to embodiments of the present invention is a molten metal stirring device that stirs, in a continuous casting device that continuously molds products by pouring a molten metal of a conductive metal into a mold, a molten metal to be poured into the mold or a molten metal in the mold.

The molten metal stirring device includes a cylindrical case with open upper side immersed in the molten metal, and a pipe housed in the case, the case has an outer cylinder and an inner cylinder housed in the outer cylinder, a gap for circulating cooling air is formed between the outer cylinder and the inner cylinder, the inner cylinder has a vent hole communicating the inside of the inner cylinder and the gap to form a cooling air passage extending from the inner cylinder to the gap via the vent hole, a magnetic field device in a state in which the pipe is inserted is housed inside the inner cylinder, in the magnetic field device, magnetic lines of force from the magnetic field device penetrate the inner cylinder and the outer cylinder to reach the molten metal, or the magnetic lines of force running in the molten metal are strongly magnetized to penetrate the inner cylinder and the outer cylinder to reach the magnetic field device, further, a first electrode penetrating the inner cylinder and the outer cylinder is provided of which one end is exposed in the inner cylinder, and the other end is exposed to the outside of the outer cylinder to be in contact with the molten metal, the one end of the first electrode is electrically connected to a lead wire running in the pipe, further a second electrode attached to the outer cylinder is provided, and the position where the second electrode is attached to the outer cylinder is set at a position where the current flowing through the molten metal between the second electrode and the first electrode crosses the magnetic lines of force to generate a Lorentz force that rotationally drives the molten metal about the longitudinal axis.

A molten metal stirring device according to the embodiments of the present invention is a molten metal stirring device that stirs, in a continuous casting device that continuously molds products by pouring a molten metal of a conductive metal into a mold, a molten metal to be poured into the mold or a molten metal in the mold.

The molten metal stirring device includes a cylindrical case with open upper side to be immersed in the molten metal, and a pipe to be housed in the case, a communication gap for communication is formed between the lower end of the pipe and the inner side of the bottom surface of the case, the inside of the pipe and the inside of the case communicate with each other through the communication gap to form a cooling air passage, a magnetic field device in a state in which the pipe is inserted is housed inside the case, in the magnetic field device, magnetic lines of force from the magnetic field device penetrate the case to reach the molten metal, or the magnetic lines of force running in the molten metal are strongly magnetized to penetrate the case to reach the magnetic field device, further, a first electrode penetrating the case is provided of which one end is exposed to the case, and the other end is exposed to the outside of the case to be in contact with the molten metal, the one end of the first electrode is electrically connected to a lead wire running in the pipe, further a second electrode attached to the case is provided, the position where the second electrode is attached to the case is set at a position where the current flowing through the molten metal between the second electrode and the first electrode crosses the magnetic lines of force to generate a Lorentz force that rotationally drives the molten metal about the longitudinal axis.

A continuous casting device system according to the embodiments of the present invention is provided with any of the above-described molten metal stirring device, a crucible for guiding molten metal from a melting furnace, and a mold attached to a bottom surface of the crucible in communication with a molten metal inlet. The molten metal stirring device is incorporated in a state in which a lower end side of the molten metal stirring device is inserted into a molten metal discharge passage in the crucible.

DESCRIPTION OF EMBODIMENTS

Figure 1:
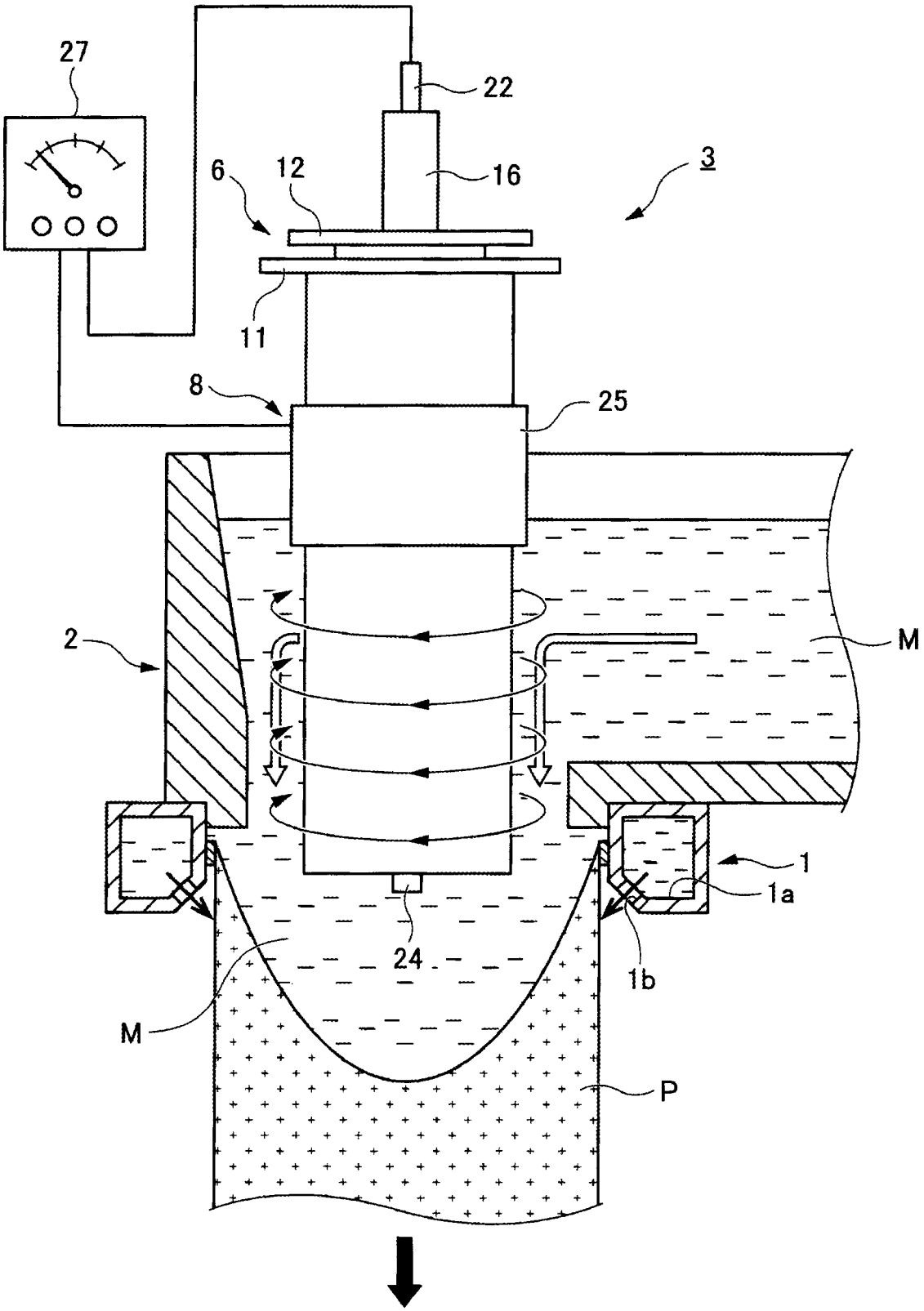
FIG. 1 is a partial longitudinal cross-sectional explanatory view illustrating the entire configuration of a continuous casting device as a first embodiment of the present invention.

FIG. 1 indicates the entire configuration of a continuous casting system as a first embodiment of the present invention, and indicates the case where a round rod-like ingot is obtained as a product P. As can be seen from this FIG. 1, this device is configured to allow a molten metal M from a melting furnace (not illustrated) of nonferrous metal or other metal of a conductor such as Al, Cu, Zn or an alloy of at least two of them, or an Mg alloy to flow into a mold 1 through a crucible 2 to finally obtain the product P. In the first embodiment of the present invention, in order to improve the quality of the finally obtained product P, a molten metal stirring device 3 is provided. That is, the molten metal stirring device 3 is held in the molten metal M at the end portion of the crucible 2 in a state of being immersed by a predetermined means. By the molten metal stirring device 3, as will be described in detail later, by a Lorentz force, the molten metal M is fed into the mold 1 while being rotationally driven around the molten metal stirring device 3, as can be seen from FIG. 1 (first embodiment). Another embodiment of the related invention will be briefly described. By the molten metal stirring device, the molten metal M in the mold 1 is fed to the mold 1 in FIG. 4 (second embodiment), and the molten metal M in the crucible 2 and in the mold 1 are both fed to the mold 1 in FIG. 6 (third embodiment), while being rotationally driven by the Lorentz force, to obtain the product P with improved quality Hereinafter, a first embodiment of the present invention will be further described in detail.

In FIG. 1, the molten metal M from a melting furnace (not illustrated) is introduced to the mold 1 by the crucible 2. That is, the mold 1 is attached to the tip (end) of the crucible 2 in a communicating state. More specifically, a molten metal inlet of the mold 1 is in communication with the bottom of the crucible 2, and a molten metal stirring device 1 is incorporated in a state in which the lower end side thereof is inserted into a molten metal discharge passage of the crucible 2.

The molten metal M passes from the crucible 2 to the mold 1 and is cooled there to obtain a so-called solid phase product P with improved quality. A so-called liquid phase molten metal M which has not been cooled down yet is present on the upper side of the product P. That is, as can be seen from FIG. 1, in the mold 1, the upper part is the molten metal M in liquid phase, and the lower part is the product P in a solid phase, and these are in contact with each other to form a downwardly convex paraboloid interface I.

Figure 2:
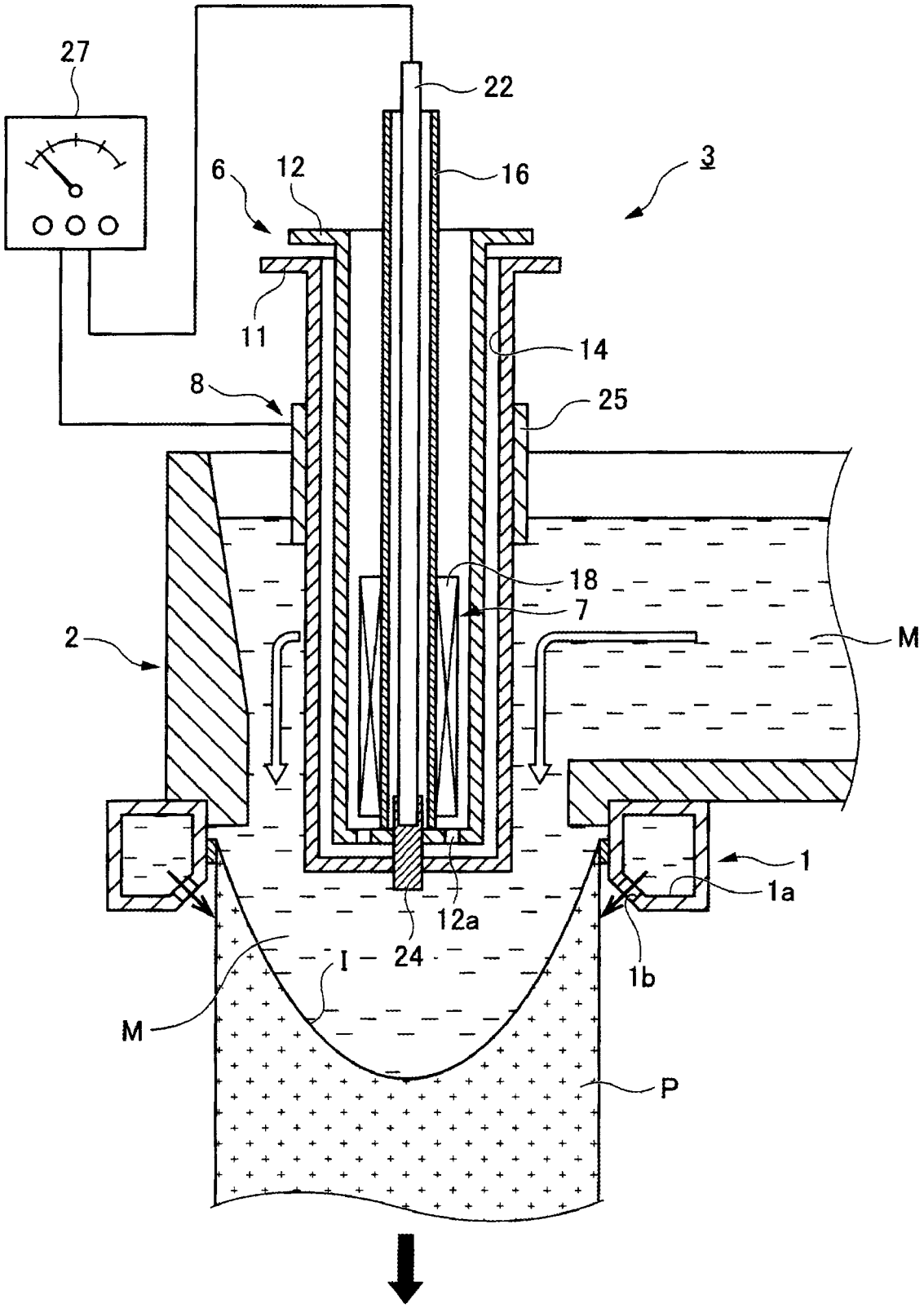
FIG. 2 is a longitudinal explanatory view which longitudinally cut the molten metal stirring device in the device of FIG. 1.

In the crucible 2, the molten metal stirring device 3 is held in a floating state by a desired means. The position of the molten metal stirring device 1 is vertically adjustable in FIG. 1 with respect to the crucible 2 and the mold 1. Therefore, in FIG. 1, the lower end of the molten metal stirring device 3 is slightly inserted into the mold 1, but the molten metal stirring device 3 can be held such that all of the molten metal stirring device 3 is present in the crucible 2. FIG. 2 is a longitudinal sectional view of the molten metal stirring device 3, and FIG. 3 is an enlarged view thereof as an operation explanatory view.

Figure 3:
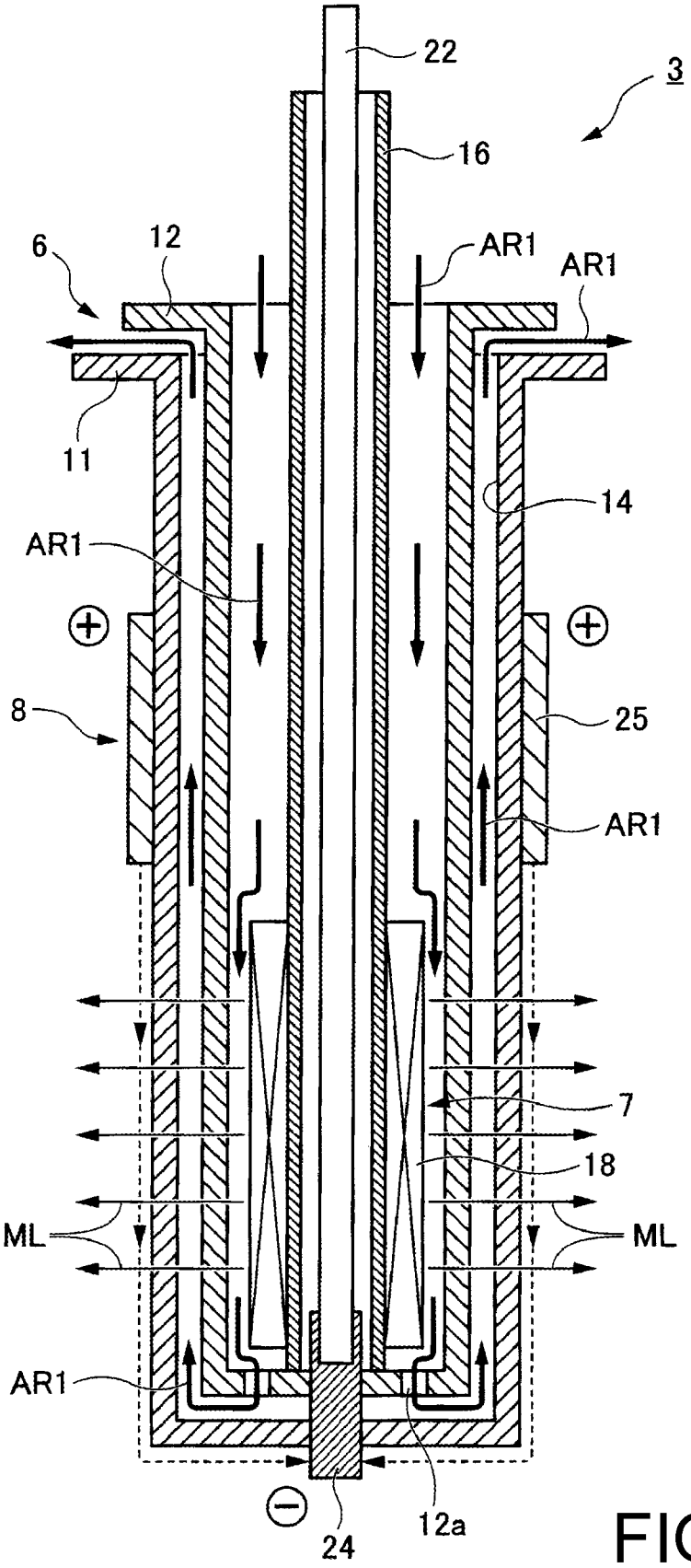
FIG. 3 is an operation explanatory view explaining operation of the molten metal stirring device in the device of FIG. 1.

In particular, as can be seen from FIG. 3, the molten metal stirring device 3 includes a substantially cylindrical case 6 having a double structure and an open upper side, a magnetic field device 7 having a permanent magnet 18 housed in the case 6, and an electrode portion 8 having a pair of electrodes (first electrode 24 and second electrode 25) attached to the case 6. The molten metal stirring device 3 is configured to have an air cooling structure capable of air cooling with compressed air, focusing on the high temperature property of the molten metal M. By this air cooling, for example, the permanent magnet 18 of the magnetic field device 7 can maintain and exert its ability.

More specifically, particularly in FIG. 3, the case 6 has an outer cylinder 11 and an inner cylinder 12 which are both made of a refractory material and formed as a cylindrical member with open upper side. A gap 14 for flowing compressed air for cooling is formed between the outer cylinder 11 and the inner cylinder 12. Furthermore, in order to pass this air for cooling, a plurality of vent holes 12*a* is formed concentrically on the bottom of the inner cylinder 12 to communicate the inside of the inner cylinder 12 with the gap 14. As a result, a cooling air passage extending from the inner cylinder 12C to the gap 14 and further to the atmosphere via the vent holes 12*a* is formed. That is, as can be seen from FIG. 3, as indicated by the arrow AR1, the compressed air for cooling flows into the inside of the inner cylinder 12 from above, reaches the bottom, reaches the bottom of the gap 14 from the vent holes 12*a*, rises in the gap 14, and is eventually released to the atmosphere. During this time, the compressed air exchanges heat in a flow path to cool the magnetic field device 7 and the like. The molten metal stirring device 3 can be fixed to a desired external fixing device by a flange portion of the outer cylinder 11. Further, in the molten metal stirring device 3, the depth of immersion in the crucible 2 and the mold 1 can be appropriately adjusted. In this way, it is possible to more appropriately stir the molten metal M by adjusting the immersion depth in accordance with the physical properties and the like of the molten metal M used on site.

Figure 8A:
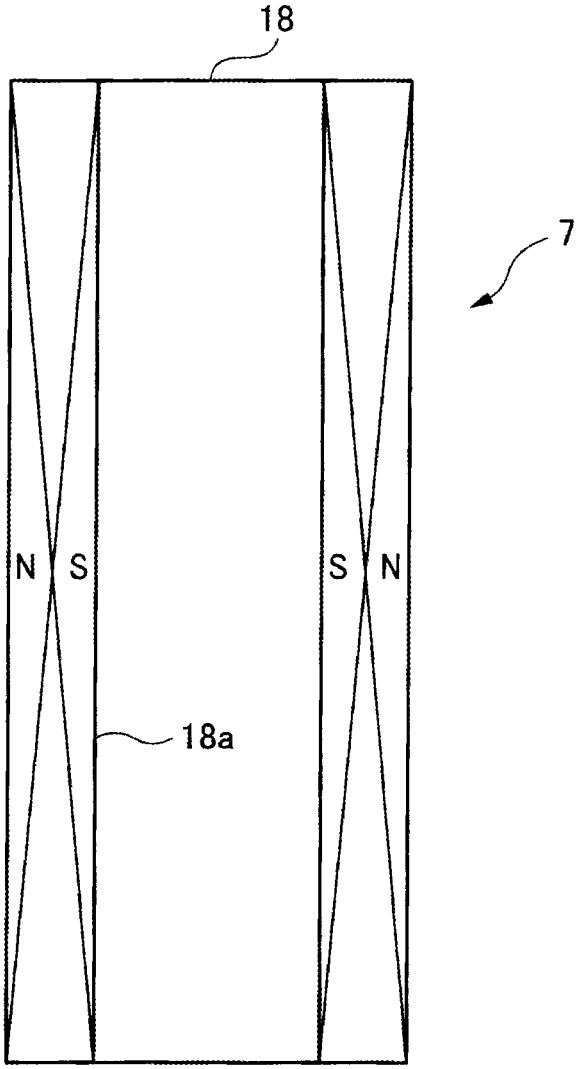
FIG. 8*a* is a longitudinal explanatory view of a magnetic field device of the molten metal stirring device in the devices of FIGS. 1 and 2.
Figure 8B:
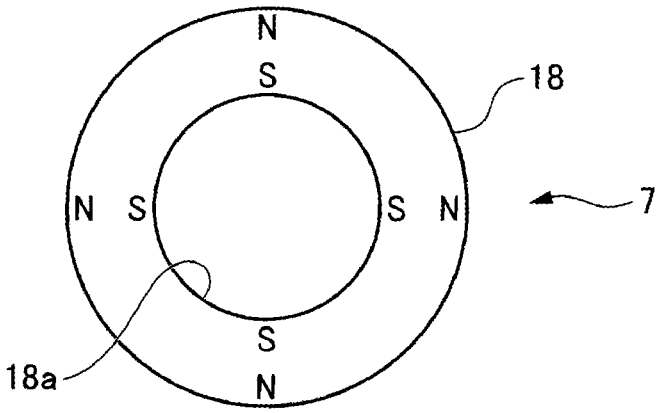
FIG. 8*b* is an explanatory plan view of the magnetic field device of the molten metal stirring device in the devices of FIGS. 1 and 2.
Figure 9A:
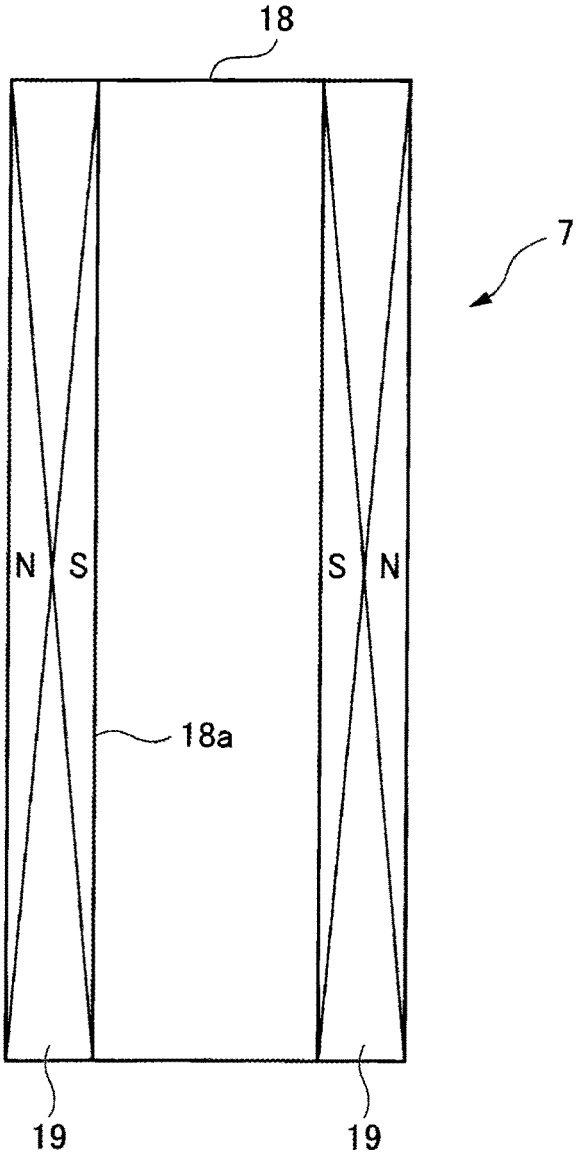
FIG. 9*a* is a longitudinal explanatory view of a modification of the magnetic field device of the molten metal stirring device in the devices of FIGS. 1 and 2.
Figure 9B:
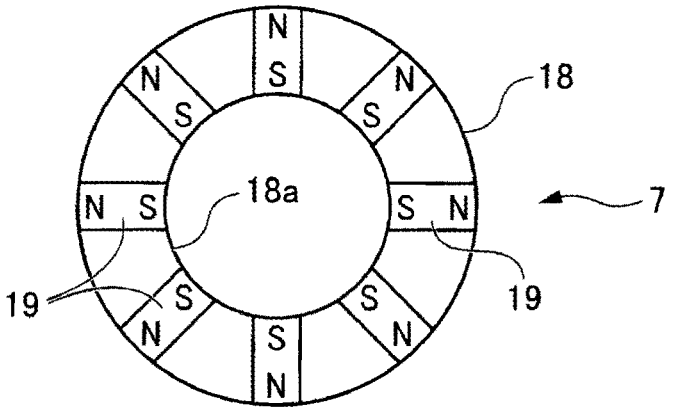
FIG. 9*b* is an explanatory plan view of a modification of the magnetic field device of the molten metal stirring device in the devices of FIGS. 1 and 2.

The magnetic field device 7 is housed in the inner cylinder 12 in a state in which a stainless steel pipe 16 is inserted, as can be seen from FIG. 3. Details of the magnetic field device 7 are illustrated in FIGS. 8*a*, 8*b*. That is, the magnetic field device 7 is configured as a cylindrical permanent magnet 18 having an integral structure, and has a through hole 18*a* for allowing the pipe 16 to penetrate in the central axis portion. The permanent magnet 18 is magnetized such that the central side is an S pole, and the outer peripheral side is an N pole. (It is obvious that the direction of magnetization may be opposite to the above. In this case, the direction of current flow can be changed by an external power supply panel 27 described later, as necessary.) As a result, as can be seen from FIG. 3, magnetic lines of force ML radiate from this magnetic field device 7 and run in the molten metal M in the crucible 2. Now that, the configuration of the magnetic field device 7 is not limited to those illustrated in FIGS. 8*a* and 8*b*, and any device may be used as long as it has the magnetic lines of force ML as illustrated in FIG. 3. For example, examples are indicated in FIGS. 9*a* and 9*b*. The permanent magnet 18 in these drawings has a plurality of rod-like permanent magnet pieces 19 which are long in the vertical direction. The aspects of magnetization of each permanent magnet piece 19 are indicated in FIGS. 9*a* and 9*b*. The magnetic field device 7 is configured by arranging the respective permanent magnet pieces 19 concentrically in plan view. As described above, the magnetic field device 7 is housed in the inner cylinder 12 in a state in which the pipe 16 is inserted, as can be seen from FIG. 3. As a result, the magnetic field device 7 radially emits the magnetic lines of force ML, which reach the molten metal M in the crucible 2 and run therethrough. When the compressed air flows in the inner cylinder 12, it reaches the vent holes 12*a* while cooling the magnetic field device 7 and the like.

As can be seen from FIG. 3, a guide rod 22 made of a conductive material such as copper, which functions as a lead wire, is housed inside the stainless steel pipe 16. The first electrode 24 made of tungsten or graphite is attached to the lower end of the guide rod 22 in an electrically conducting state. The first electrode 24 penetrates the inner cylinder 12 and the outer cylinder 11 in a liquid tight state (at least a molten metal-tight state), exposes the tip (lower end) to the outside, and contacts the molten metal M in the crucible 2.

A second electrode 25 formed in, for example, a ring shape of graphite or the like, which makes a pair with the first electrode 24, is attached to the outer peripheral surface of the outer cylinder 11 so as to be detachably inserted. Thereby, when the molten metal stirring device 3 is immersed in the molten metal M of the crucible 2, as illustrated in FIG. 3, a current i flows from the second electrode 25 to the first electrode 24 via the molten metal M. As a result, the magnetic lines of force ML from the magnetic field device 7 and the current i flowing between the first electrode 24 and the second electrode 25 intersect to generate a Lorentz force. Thereby, as illustrated in FIG. 1, the molten metal M in the crucible 2 is rotationally driven. Now, the second electrode 25 can be replaced with another one as needed, for example, at the time of wear and tear.

The molten metal M in the crucible 2 can be rotationally driven, that is, stirred, and the following advantages can be obtained.

First, impurities present inside rises in the molten metal M and gather on a surface portion, and the quality of the molten metal M other than the surface portion, that is, the molten metal M flowing into the mold 1 is improved. Thereby, the quality of the product P obtained by the mold 1 can be improved.

Further, the molten metal M is stirred in the crucible 2 and flows into the mold 1 while rotating. Thereby, the molten metal M is also rotated in the mold 1. That is, the molten metal M is also rotationally driven indirectly also in the mold 1. By the rotation in the mold 1, the molten metal M solidifies in a state where the temperatures of the inner portion and the outer portion are averaged. As a result, in combination with the removal of impurities in the molten metal M as described above, the product P with more excellent quality can be obtained. Such a mechanism for quality improvement applies to all the other embodiments and variations described below.

Referring back to FIG. 1, the first electrode 24 and the second electrode 25 are connected to the external power supply panel 27 such that a desired DC current can be supplied. The amount of supplied current can be adjusted by the external power supply panel 27, and a polarity can also be switched. By switching the polarity, the rotation direction of the molten metal M in the crucible 2 and the mold 1 can be reversed. Such control can also be performed while watching the stirring state of the molten metal M on site. As a result, the product P with high quality can be obtained without being influenced by the characteristics of the molten metal M to be used by controlling individually for each characteristic of the molten metal M. Moreover, such control is possible by simple operation with the external power supply panel 27, and the utility on site is extremely high.

For example, as can be seen from FIG. 1, a circulation path 1*a* for circulating cooling water is formed inside the mold 1. Among the circulation paths 1*a*, a plurality of places facing the product P are used as cooling water ports 1*b* penetrating to the outside. The products P are manufactured while being cooled by the cooling water discharged from the cooling water ports 1*b*. As described above, since the molten metal M is rotationally driven also in the mold 1, it is possible to obtain the product P with higher quality by achieving uniform temperature. The reason why the shape of the interface I is a downwardly convex paraboloid as indicated in FIG. 1 is that the cooling rates of the outer portion and the inner portion of the molten metal M are different. A curve in the vicinity of the apex of the paraboloid of the interface I becomes steep as the size of the product P increases, that is, as cross-over of the cross section increases. Further, as a drawing speed of the product P increases, the above-described curve becomes further sharp as well. As a result, the difference between the cooling rates of the outer and inner portions increases. As a result, the occurrence of variations in the internal quality of the product P cannot be avoided. However, as described above, since the molten metal M is stirred also in the mold 1 to make the temperature uniform, products with higher quality can be achieved because impurities are also removed in the crucible 2.

Although the operation of the first embodiment of the present invention can be understood from the above description, it will be briefly described below.

From the external power supply panel 27 of FIG. 1, as illustrated in FIG. 3, the current i is allowed to flow between a pair of the electrodes (first electrode 24 and second electrode 25). The current i intersects the magnetic line of force ML to generate a Lorentz force f. By the Lorentz force f, the molten metal M in the crucible 2 (and a small amount of the molten metal M in the mold 1) is rotationally driven as illustrated in FIG. 1. Thereby, the molten metal M flows into the mold 1 while rotating, and is cooled by the cooling water from the cooling water port 1*b* and solidified while being rotated in the mold 1 to form the product P. Here, the rotational speed of the molten metal M in the crucible 2 and in the mold 1 can be adjusted by adjusting the amount of current from the external power supply panel 27. That is, although the quality, properties, components, etc. of the molten metal M flowing from a melting furnace (not illustrated) are not always the same, the amount of current is adjusted depending on the quality, properties, etc. of the molten metal M used, and the product P with more appropriate quality can be obtained regardless of the physical properties of the molten metal M. Further, by changing the flow direction of the current i little by little, the direction of rotation of the molten metal M in the crucible 2 can be changed in a very short time so as to be in a so-called vibration state, whereby the removal of impurities can be further promoted.

Next, a second embodiment of the present invention will be described.

Figure 4:
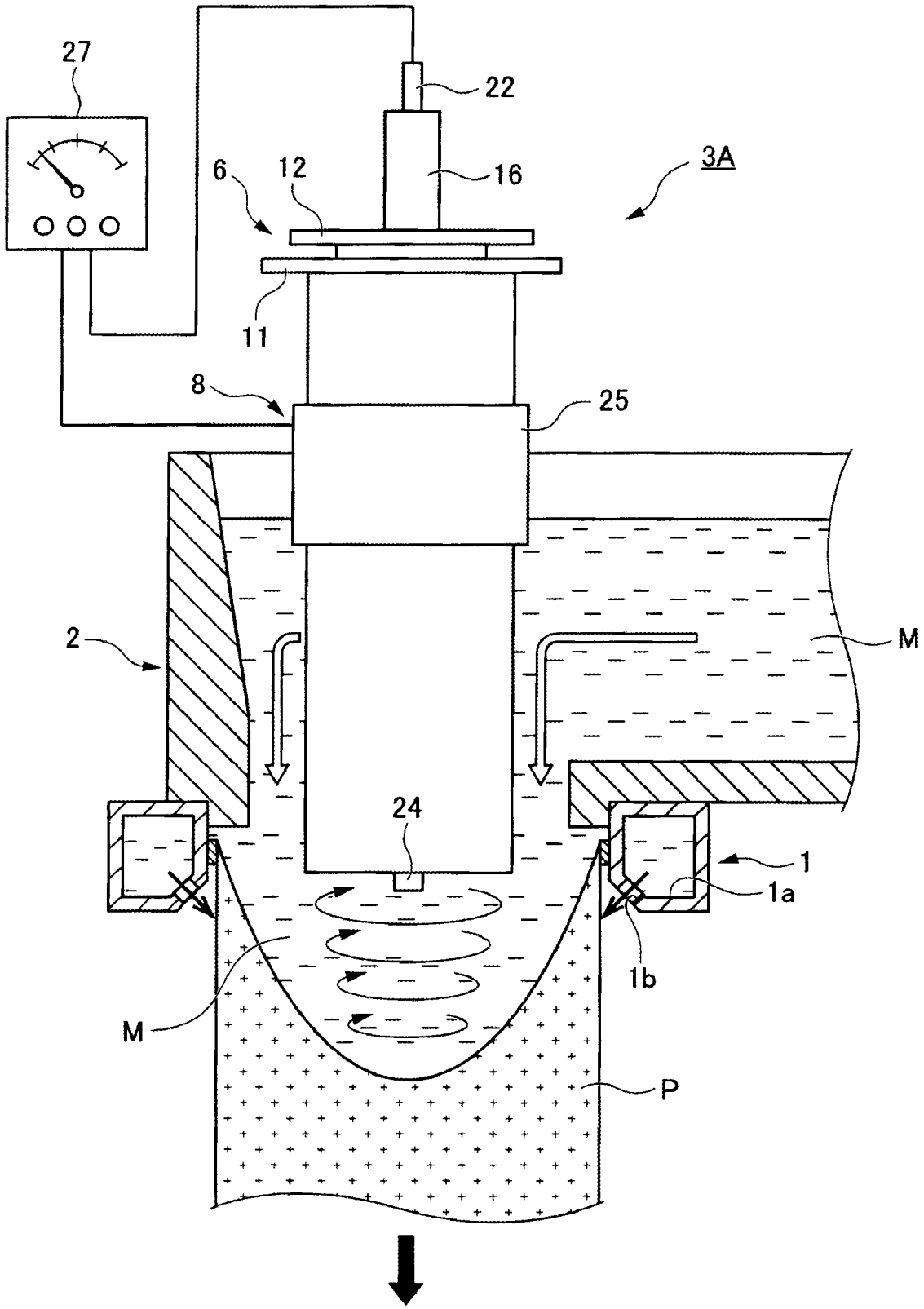
FIG. 4 is a partial longitudinal cross-sectional explanatory view illustrating the entire configuration of a continuous casting device as a second embodiment of the present invention.

According to the second embodiment of the present invention, as can be seen particularly from FIG. 4, a permanent magnet 18A (refer to FIG. 5) mounted on a molten metal stirring device 3A rotationally drives the molten metal M in the mold 1 before solidification, not the molten metal M in the crucible 2 Even if the molten metal M in the mold 1 is stirred, as can be understood from the description of the first embodiment of the present invention, it is obvious that substantially the same effects as those of the first embodiment of the present invention can be obtained.

Figure 5:
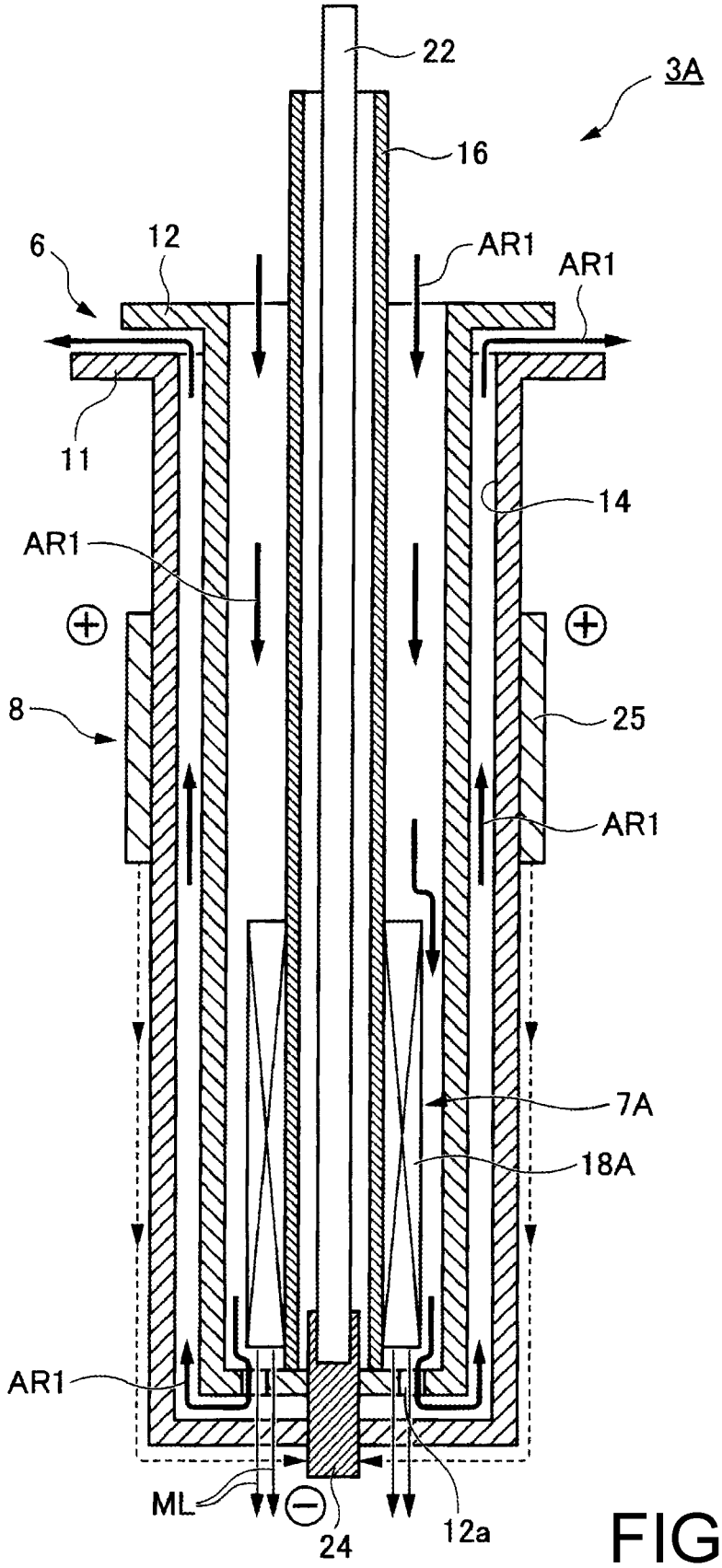
FIG. 5 is an operation explanatory view explaining operation of the molten metal stirring device in the device of FIG. 4.
Figure 10A:
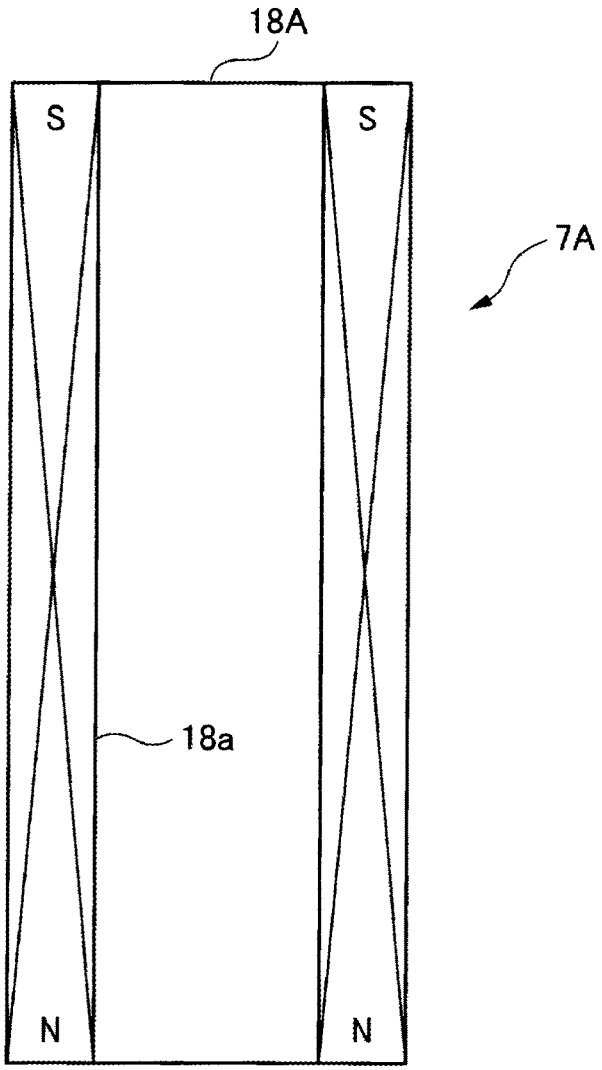
FIG. 10*a* is a longitudinal explanatory view of a magnetic field device of the molten metal stirring device in the devices of FIGS. 4 and 5.
Figure 10B:
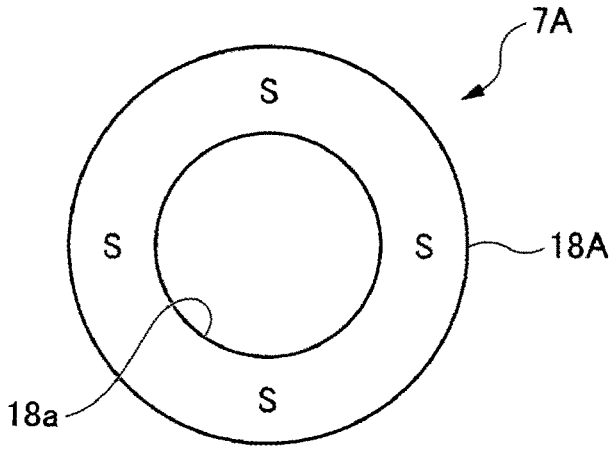
FIG. 10*b* is an explanatory plan view of the magnetic field device of the molten metal stirring device in the devices of FIGS. 4 and 5.

Hereinafter, points different from the first embodiment of the present invention will be mainly described. FIG. 5 is a vertically enlarged operation explanatory view of the molten metal stirring device 3A mounted according to the second embodiment of the present invention illustrated in FIG. 4. The molten metal stirring device 3A illustrated in FIG. 5 differs from the molten metal stirring device 3 illustrated in FIG. 3 only in the direction of the magnetic lines of force ML, and the other configuration is substantially the same, as can be easily seen from the comparison of the drawings. That is, the permanent magnet 18A of the magnetic field device 7A of FIG. 5 emits the magnetic lines of force ML in the lower side in the drawing. Details of the magnetic field device 7A are illustrated in FIGS. 10*a* and 10*b*. FIG. 10*a* is a longitudinal sectional view, and FIG. 10*b* is a plan view. As can be seen from these drawings, the outer shape is almost the same as in FIGS. 8*a* and 8*b*, but the aspect of magnetization is different, and the upper part of the cylindrical body is magnetized to the S pole and the lower part to the N pole.

As can be seen from FIG. 5, the magnetic lines of force ML from the magnetic field device 7A and the current i flowing between a pair of the electrodes (the first electrode 24 and the second electrode 25) cross on the outside of the bottom of the outer cylinder 11 of the magnetic field device 7A. The molten metal M in the mold 1 is rotationally driven as illustrated in FIG. 4 by the Lorentz force f generated thereby.

As described above, in the second embodiment of the present invention, configurations and operations other than those described above are substantially the same as those in the first embodiment of the present invention, and thus detailed descriptions thereof will be omitted.

Next, a third embodiment of the present invention will be described.

Figure 6:
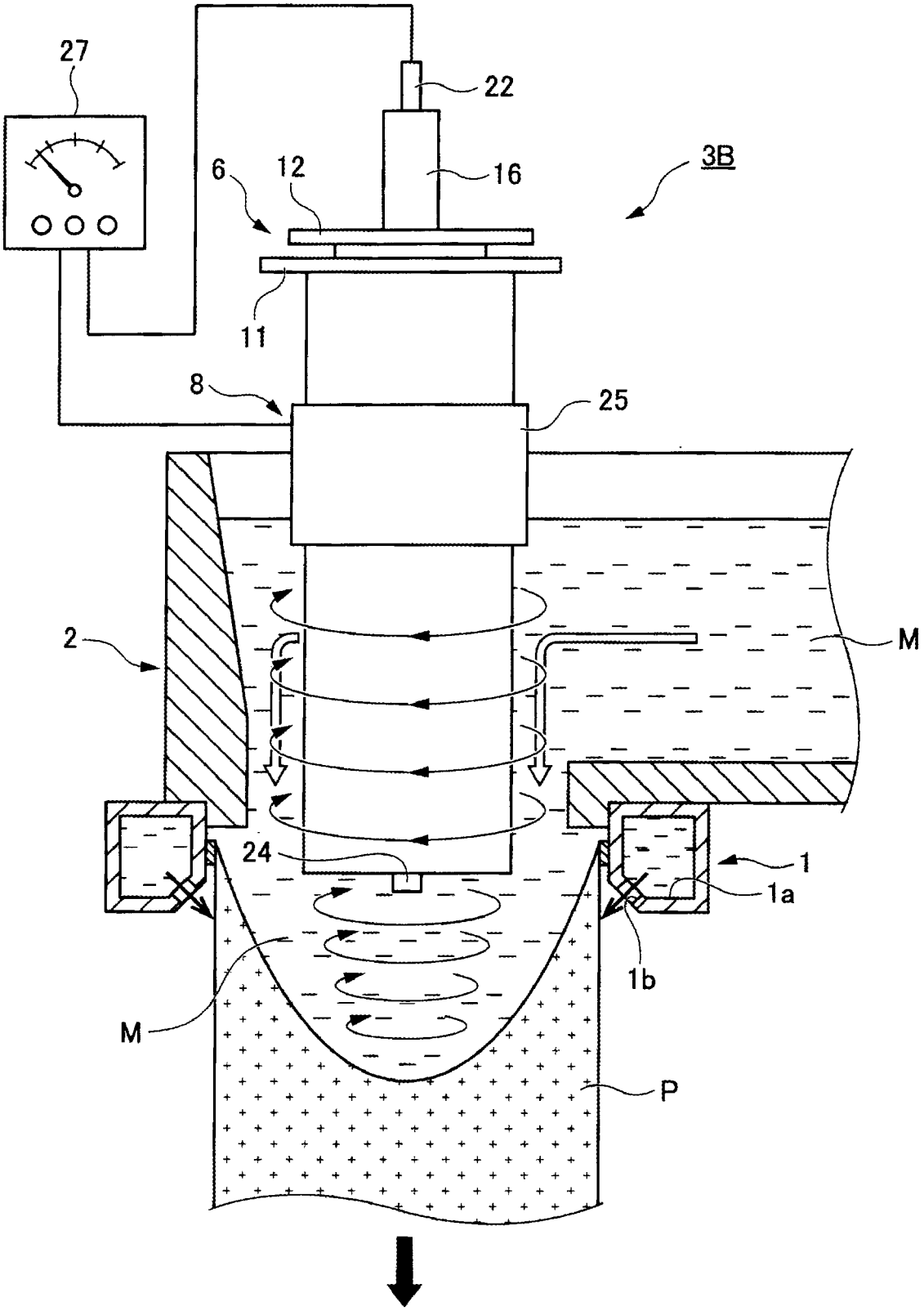
FIG. 6 is a partial longitudinal cross-sectional explanatory view illustrating the entire configuration of a continuous casting device as a third embodiment of the present invention.

According to the third embodiment of the present invention, as can be seen in particular from FIG. 6, by permanent magnets 18B1 and 1862 (refer to FIG. 7) mounted on a molten metal stirring device 3B, both the molten metal M in the crucible 2 and the molten metal M in the mold 1 before solidification are directly rotationally driven together. Since the molten metal M in the crucible 2 and the molten metal M in the mold 1 are directly stirred together, it is obvious that substantially the same or more advantages as those of the first embodiment of the present invention and the second embodiment of the present invention can be obtained.

Figure 7:
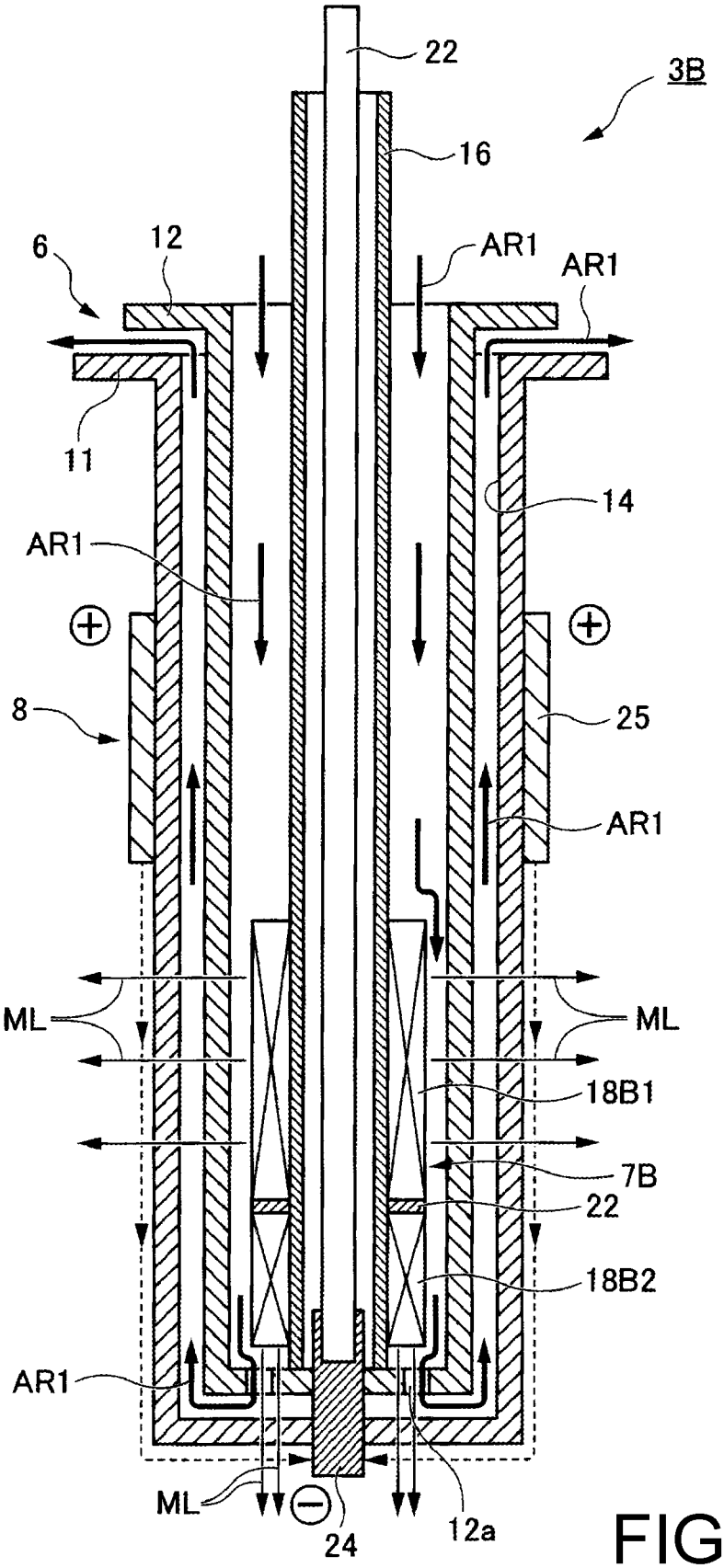
FIG. 7 is an operation explanatory view explaining operation of the molten metal stirring device in the device of FIG. 6.
Figure 11A:
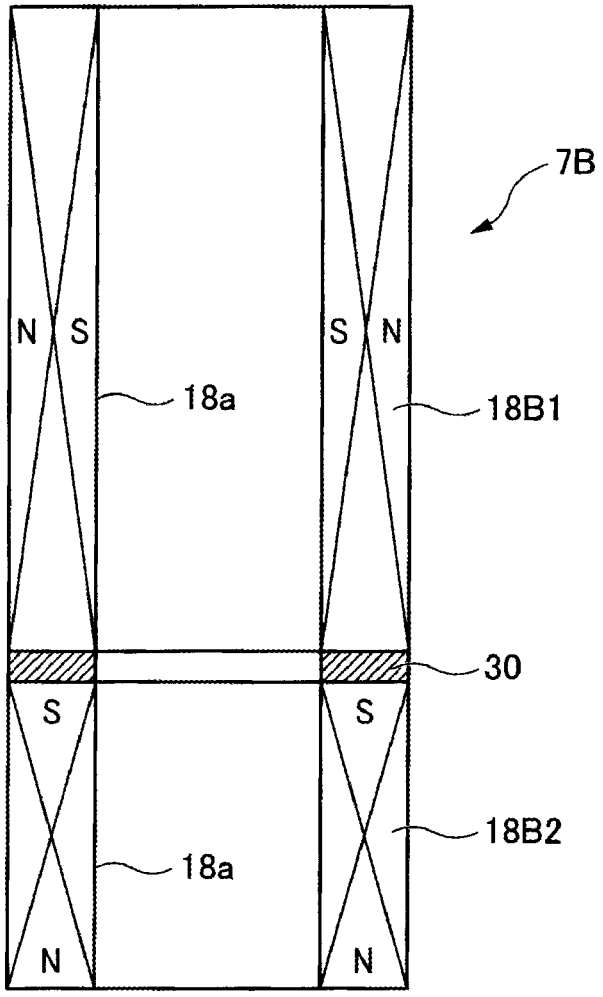
FIG. 11*a* is a longitudinal explanatory view of a magnetic field device of the molten metal stirring device in the devices of FIGS. 6 and 7.
Figure 11B:
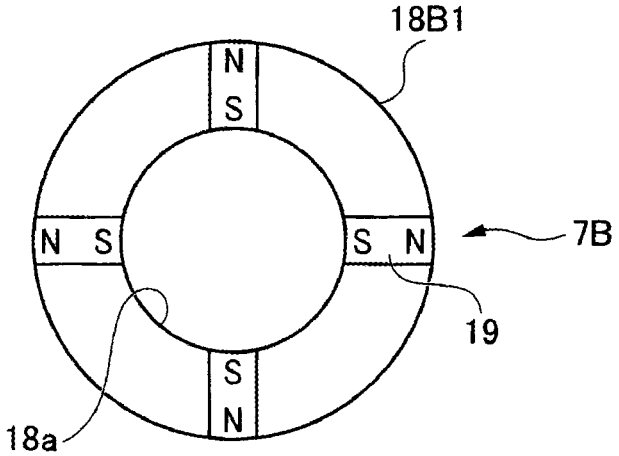
FIG. 11*b* is an explanatory plan view of the magnetic field device of the molten metal stirring device in the devices of FIGS. 6 and 7.
Figure 11C:
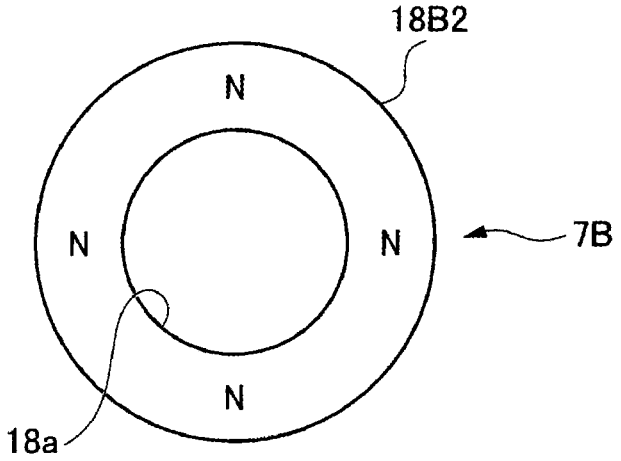
FIG. 11*c* is an explanatory bottom view of the magnetic field device of the molten metal stirring device in the devices of FIGS. 6 and 7.

More specifically, FIG. 7 is a longitudinal enlarged operation explanatory view of the molten metal stirring device 3B of FIG. 6. The molten metal stirring device 3B (third embodiment) illustrated in FIG. 7 have functions both of the molten metal stirring device 3 (first embodiment) illustrated in FIG. 3 and the molten metal stirring device 3B (second embodiment) illustrated in FIG. 5. As can be seen from FIG. 7, in the specific configuration, the magnetic field device 7B is integrally fixed in a state in which the first cylindrical permanent magnet 18B1 and the second cylindrical permanent magnet 18B2 are stacked vertically through a nonmagnetic spacer 30, and the details of them are illustrated in FIG. 11*a* (vertical explanatory view), FIG. 11*b* (top view) and FIG. 11*c* (bottom view). As can be seen from FIGS. 11*a* and 11*b*, the first permanent magnet 18B1 includes a plurality of permanent magnet pieces 19 as with those illustrated in FIGS. 9*a* and 9*b*, and the inner side is set to the S pole, and the outer side is set to the N pole. Further, as can be seen from FIGS. 11*a* and 11*c*, the second permanent magnet 18B2 is magnetized with the N pole at the upper side and the S pole at the lower side, as in the case illustrated in FIGS. 10*a* and 10*b*. The first permanent magnet 18B1 and the second permanent magnet 18B2 are integrally formed across the spacer 30.

As can be seen from FIG. 7, the magnetic lines of force ML from the permanent magnet 18B1 of the magnetic field device 7B and the current i flowing between a pair of the electrodes (first electrode 24 and second electrode 25) cross on the outside of the side surface of the outer cylinder 11. Further, the magnetic lines of force ML from the second permanent magnet 18B2 of the magnetic field device 7B and the current i flowing between a pair of the electrodes (first electrode 24 and second electrode 25) cross on the outside of the outer cylinder 11 of the magnetic field device 7A. Due to two types of the Lorentz force f generated thereby, as illustrated in FIG. 6, in the crucible 2, it is rotationally driven on the outside of the outer peripheral surface of the magnetic field device 7B and on the outside of the bottom in the mold 1.

In the third embodiment of the present invention, configurations and operations other than those described above are substantially the same as those in the first and second embodiments of the present invention, and thus detailed descriptions thereof will be omitted.

In the first to third embodiments of the present invention described above, the case 6 has a double structure of the outer cylinder 11 and the inner cylinder 12, and the gap 14 is formed between them, and compressed air for cooling is distributed to the gap 14. However, the strength of the case 6 can also be increased by overlapping the outer cylinder 11 and the inner cylinder 12 in close contact without gaps. In this case, a flow path of the cooling air is secured separately. The fourth to sixth embodiments of the present invention embodying this technical concept are illustrated in FIGS. 12 to 16. In these embodiments, compressed air for cooling is fed from the pipe 16C.

Next, first a fourth embodiment of the present invention will be described.

Figure 12:
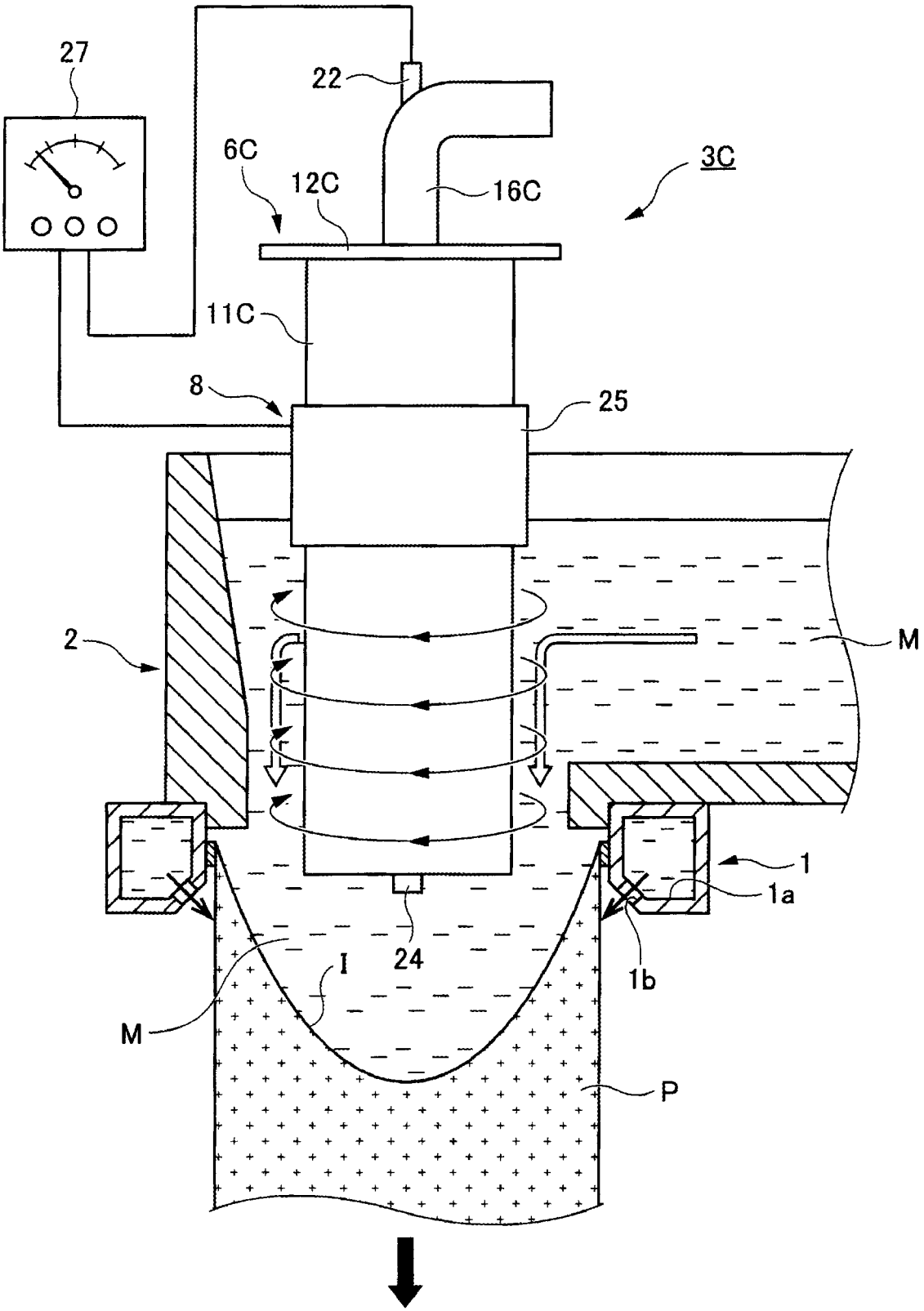
FIG. 12 is a partial longitudinal cross-sectional explanatory view illustrating the entire configuration of a continuous casting device as a fourth embodiment of the present invention.
Figure 13:
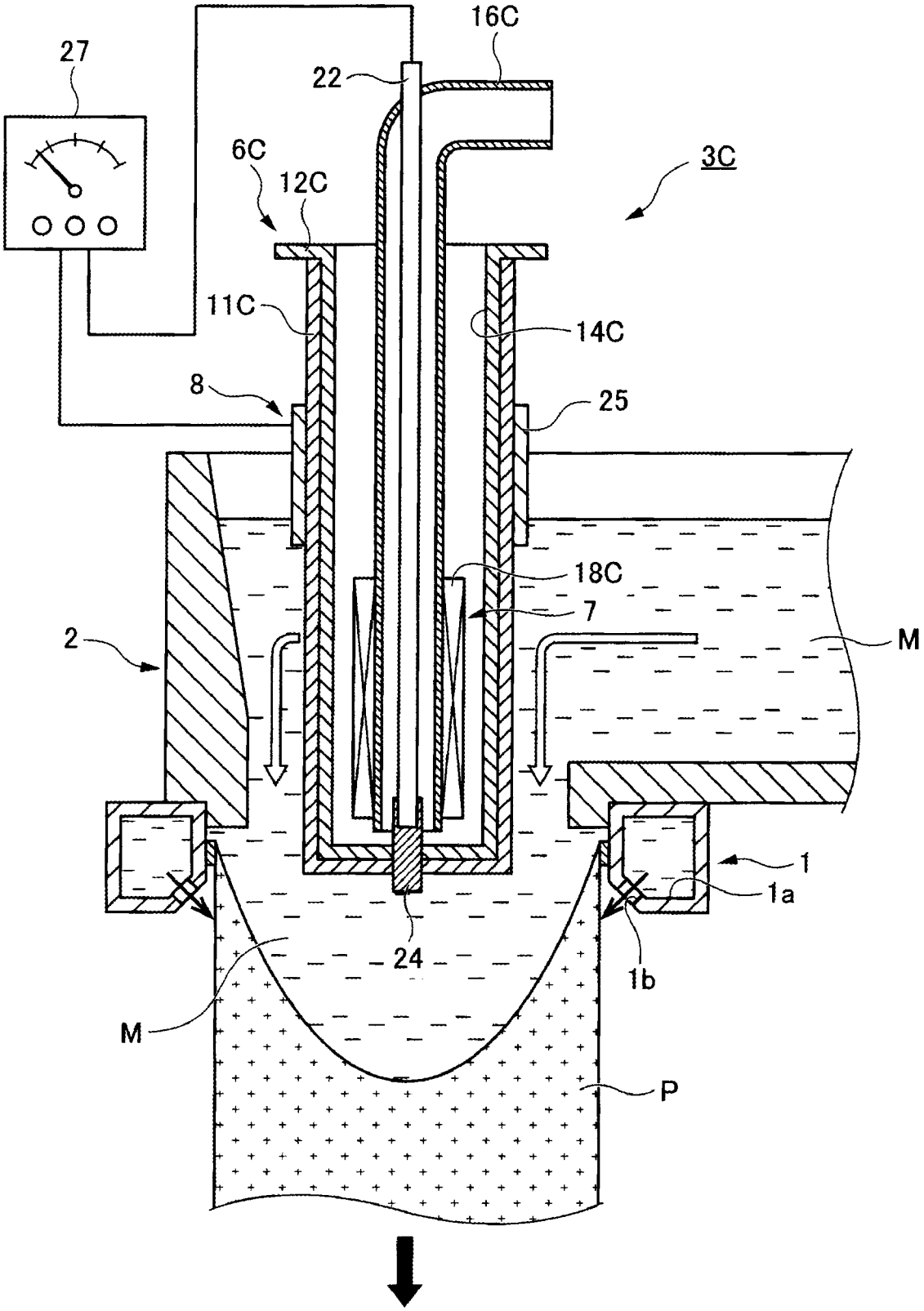
FIG. 13 is a longitudinal explanatory view which longitudinally cut the molten metal stirring device in the device of FIG. 12.
Figure 14:
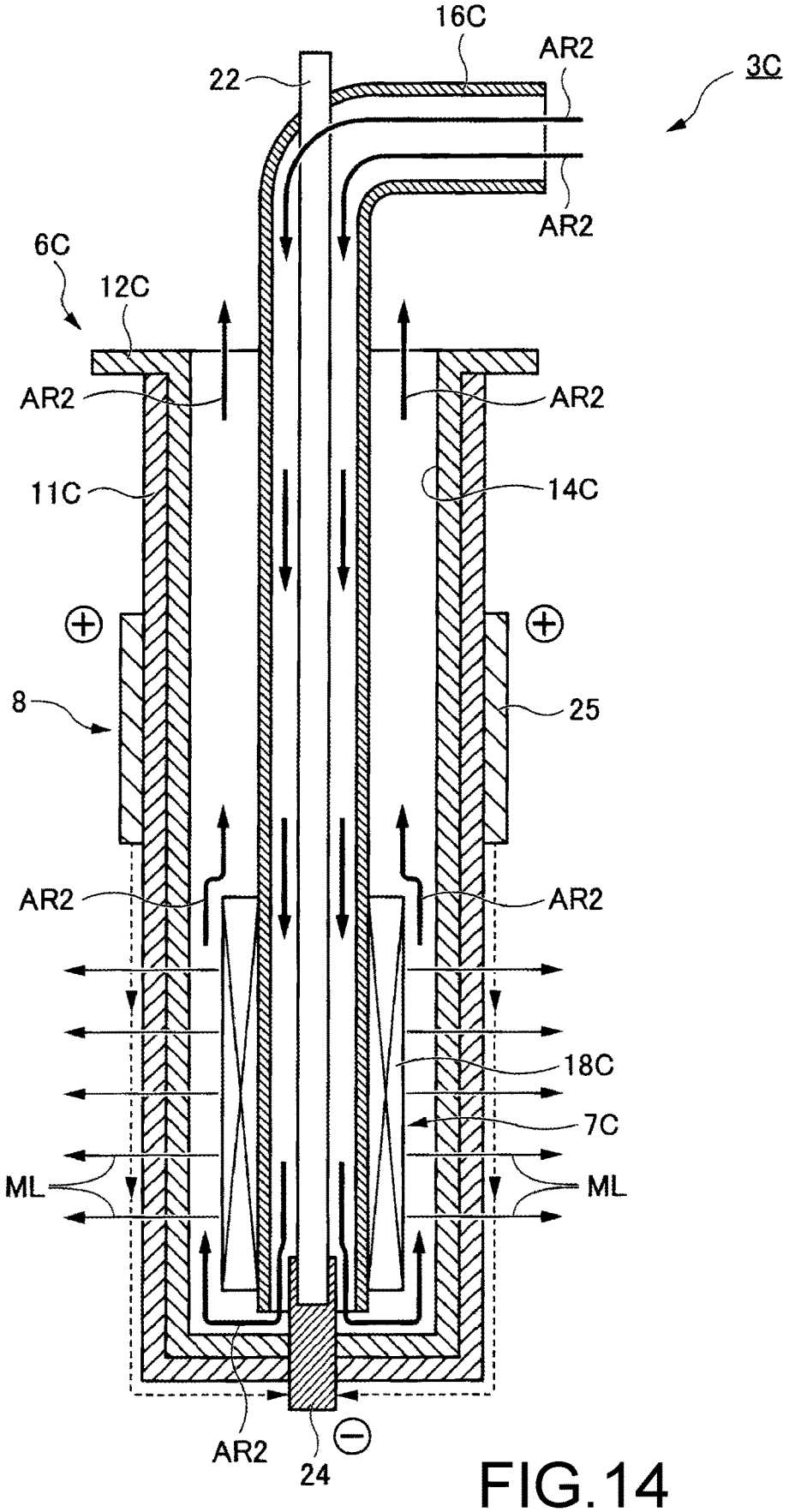
FIG. 14 is an operation explanatory view explaining operation of the molten metal stirring device in the devices of FIGS. 12 and 13.

A fourth embodiment of the present invention is illustrated in FIGS. 12 to 14. As can be seen particularly from FIG. 14, in the present embodiment, the molten metal M in the mold 1 before solidification is rotationally driven by the permanent magnet 18C mounted on the molten metal stirring device 3C. In the fourth embodiment of the present invention, a permanent magnet equivalent to those illustrated in FIGS. 8*a* and 8*b* is used. The molten metal stirring device 3C of FIG. 14 (the fourth embodiment of the present invention) and the molten metal stirring device 3 of FIG. 3 (the first embodiment of the present invention) are different in that the case 6C is formed by polymerizing the outer cylinder 11C and the inner cylinder 12C without a gap, and compressed air for cooling is fed from a slightly thicker pipe 16C. The inner cylinder 12C can be configured to function as a heat insulating cylinder by a heat insulating member. A communication gap for communication is formed between a lower end of the pipe 16C and a bottom surface of the inner cylinder 12C. Thus, the inside of the pipe and the inside of the case communicate with each other through the communication gap to form a cooling air passage, and the inside of the pipe and the inside of the inner cylinder are communicated through the communication gap to form the cooling air passage. As a result, the compressed air fed into the pipe 16C reaches a gap 14C between the pipe 16C and the inner cylinder 12C from the lower end of the pipe 16C as indicated by an arrow AR2, and is inverted and raised to be discharged to the outside. The permanent magnet 18C and the like are cooled by the reversing and rising compressed air.

Other configurations and operations in the fourth embodiment are the same as those in the above-described embodiment, and thus detailed description will be omitted.

Next, a fifth embodiment of the present invention will be described.

Figure 15:
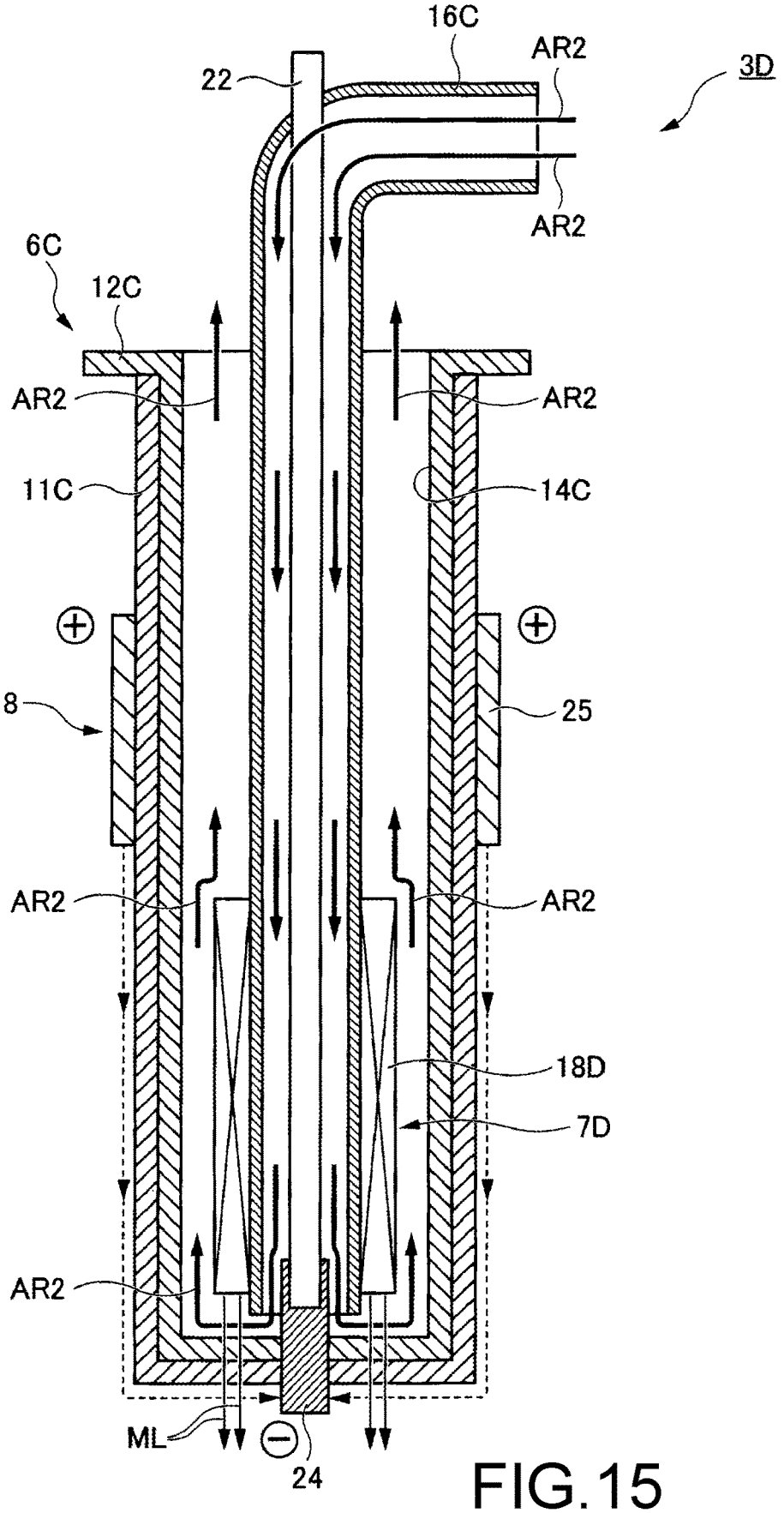
FIG. 15 is a structural operation explanatory view for explaining the configuration and operation of a molten metal stirring device used for a continuous casting device as a fifth embodiment of the present invention.

The fifth embodiment of the present invention is to directly drive the molten metal M in the mold 1 as in the second embodiment of the present invention of FIG. 4. FIG. 15 illustrates a molten metal stirring device 3D as a principal part. In the fourth embodiment of the present invention, a magnetic field device 7D with a permanent magnet 18D equivalent to that illustrated in FIG. 10*a* is used. Other configurations and operations are substantially the same as those in FIGS. 14 and 5, and therefore detailed description will be omitted.

Next, a sixth embodiment of the present invention will be described.

Figure 16:
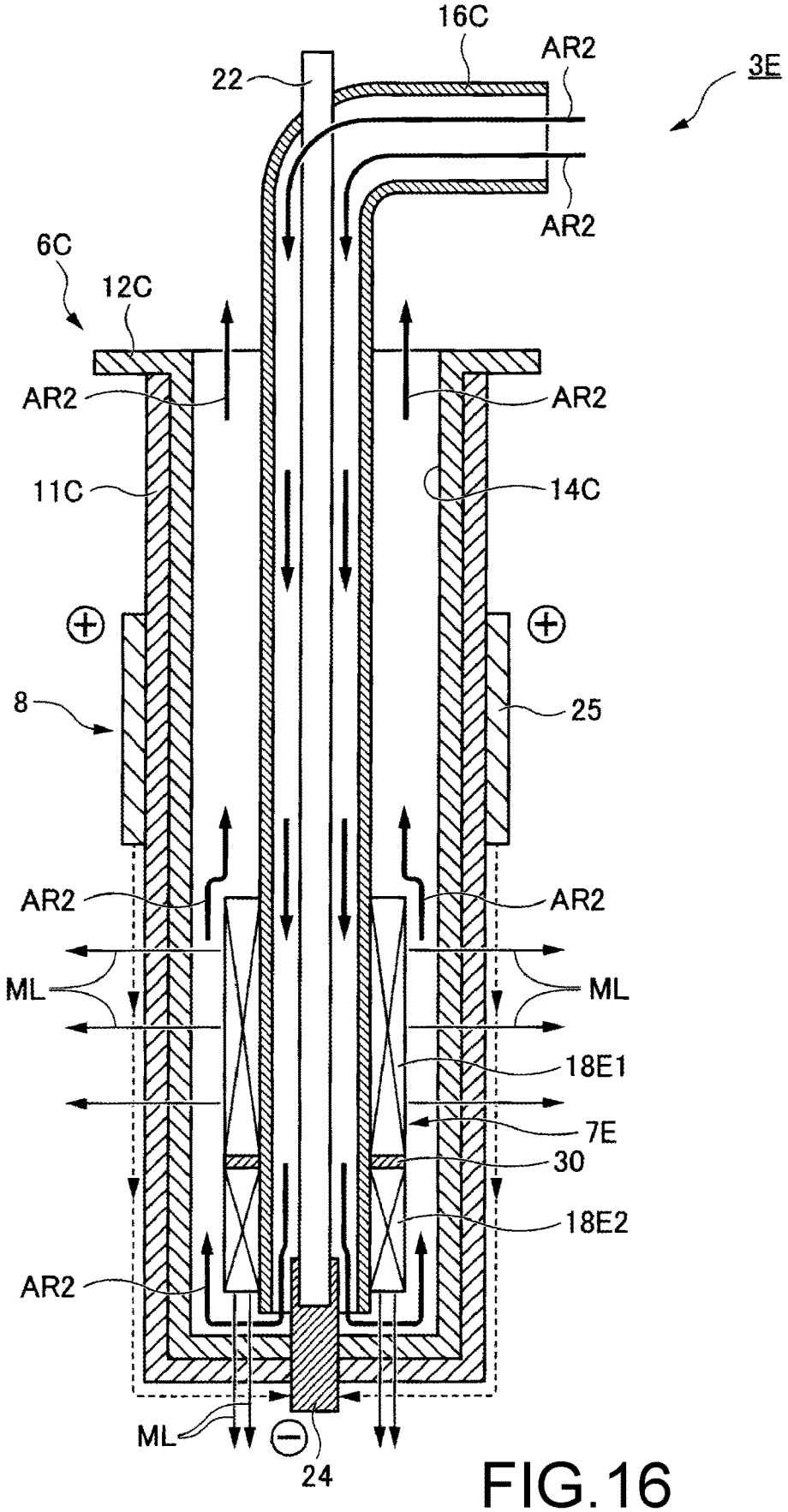
FIG. 16 is a structural operation explanatory view for explaining the configuration and operation of a molten metal stirring device used for a continuous casting device as a sixth embodiment of the present invention.

The sixth embodiment of the present invention is to directly drive the molten metal M in the crucible 2 and the molten metal M in the mold 1 as in the third embodiment of the present invention of FIG. 6. A molten metal stirring device 3E as a principal part is shown in FIG. 16. In the sixth embodiment of the present invention, a magnetic field device 7E with a first permanent magnet 18E1 and a second permanent magnet 18E2 equivalent to those illustrated in FIG. 11*a* is used. The other configuration is substantially the same as those in FIGS. 14 and 7, and therefore detailed description will be omitted.

Next, a seventh embodiment of the present invention will be described.

Figure 2A:
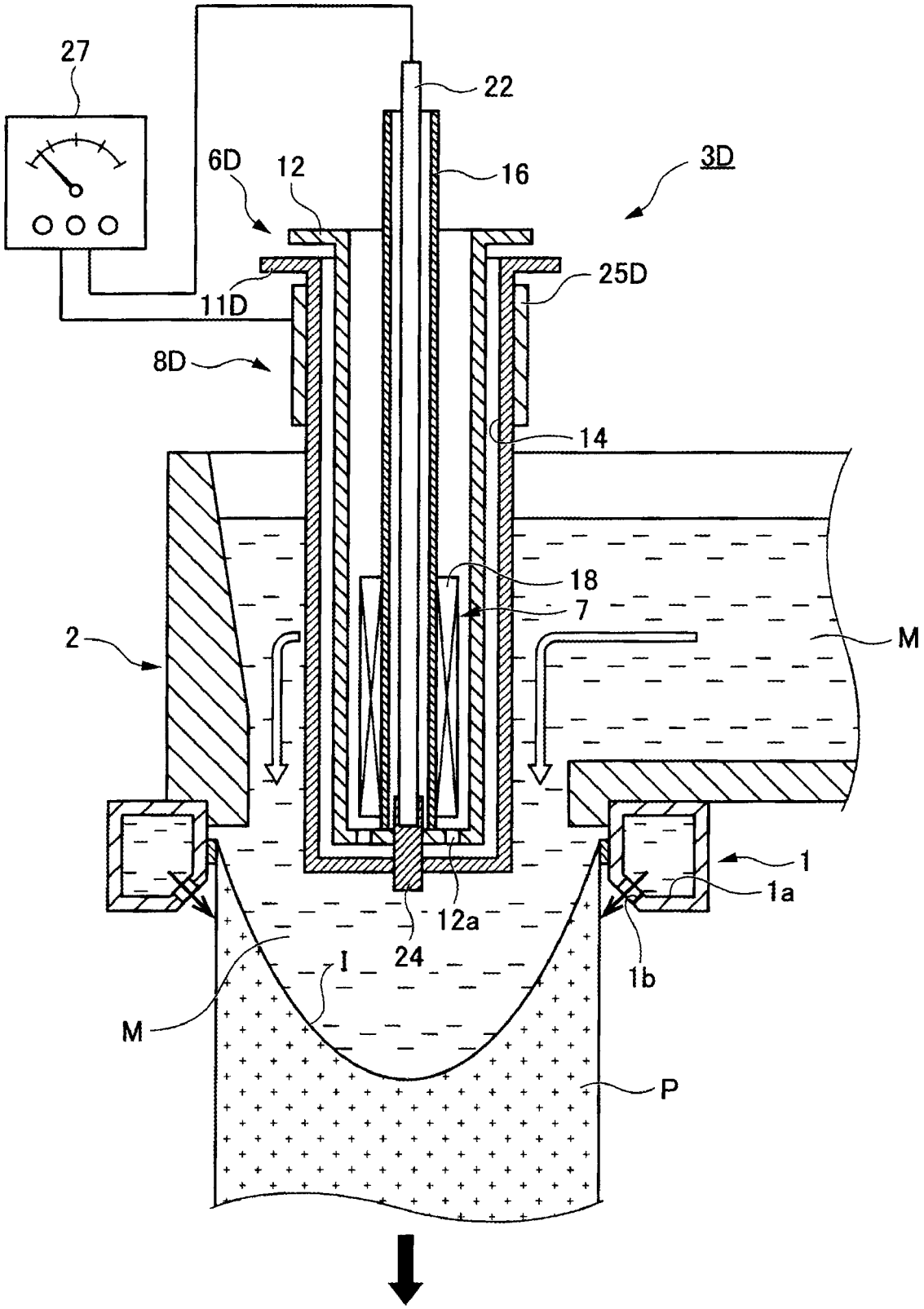
FIG. 2A is a partial longitudinal cross-sectional explanatory view illustrating the entire configuration of a continuous casting device of a seventh embodiment corresponding to the embodiment of FIG. 2.

The seventh embodiment of the present invention is illustrated in FIG. 2A, and the outer cylinder 11D in the case 6D is made of a conductive material that generates heat by energization to reach several hundred degrees close to the temperature of the molten metal. Further, the electrical resistance of this conductive material is larger than that of the molten metal M used. As the conductive material, various materials such as graphite can be used, and any material may be used as long as it has fire resistance and is resistant to the molten metal used.

Further, the upper second electrode 25D of the electrode portion 8D is provided above the second electrode 25 of FIG. 2 so as not to contact the molten metal M in actual use.

The other configuration is substantially the same as the embodiment of FIG. 2.

In the seventh embodiment of the present invention, as described above, the outer cylinder 11D is capable of self-heating by energization. Due to its self-heating, for example, the outer cylinder 11D can reach several hundred degrees Thus, by setting to a high temperature by energization prior to actual use, it can be immediately sunk in the molten metal in actual use, and it is possible to reduce waste of time as much as possible. That is, according to this embodiment, it is not necessary to wait for several hours to submerge the molten metal stirring device 3D in the molten metal and actually operate it.

Figure 2B:
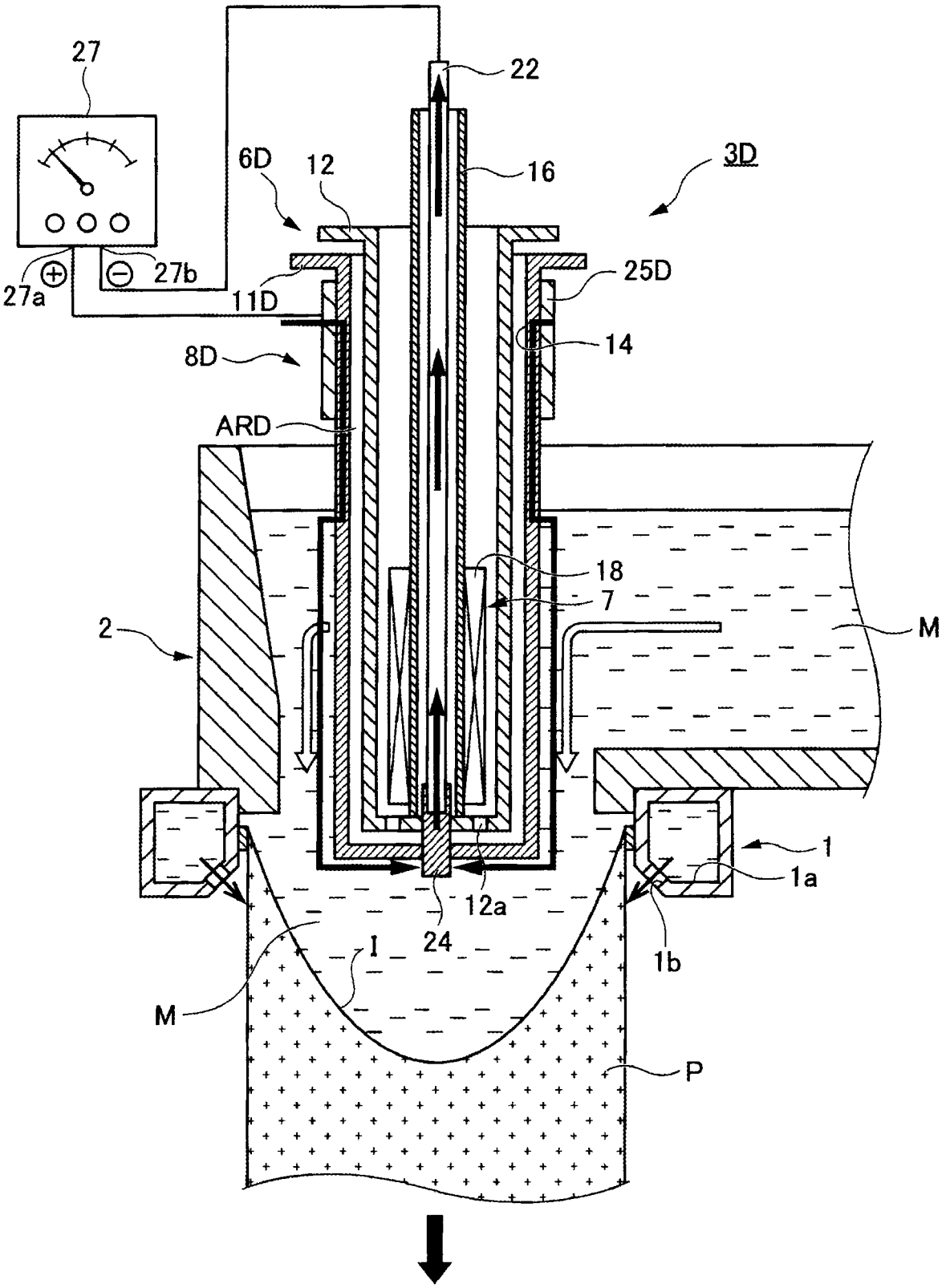
FIG. 2B is an explanatory view illustrating a current flow path according to the embodiment of FIG. 2A.

FIG. 2B is an explanatory view illustrating paths of current in the molten metal stirring device 3D. As can be seen from the arrow ARD in FIG. 2B, the current from a positive terminal 27*a* of the external power supply panel 27 passes from the second electrode 25D through the outer cylinder 11D such as graphite, flows in the molten metal M having a relatively low electric resistance, reaches the first electrode 24, and returns to the negative terminal 27*b* of the external power supply panel 27.

Figure 13A:
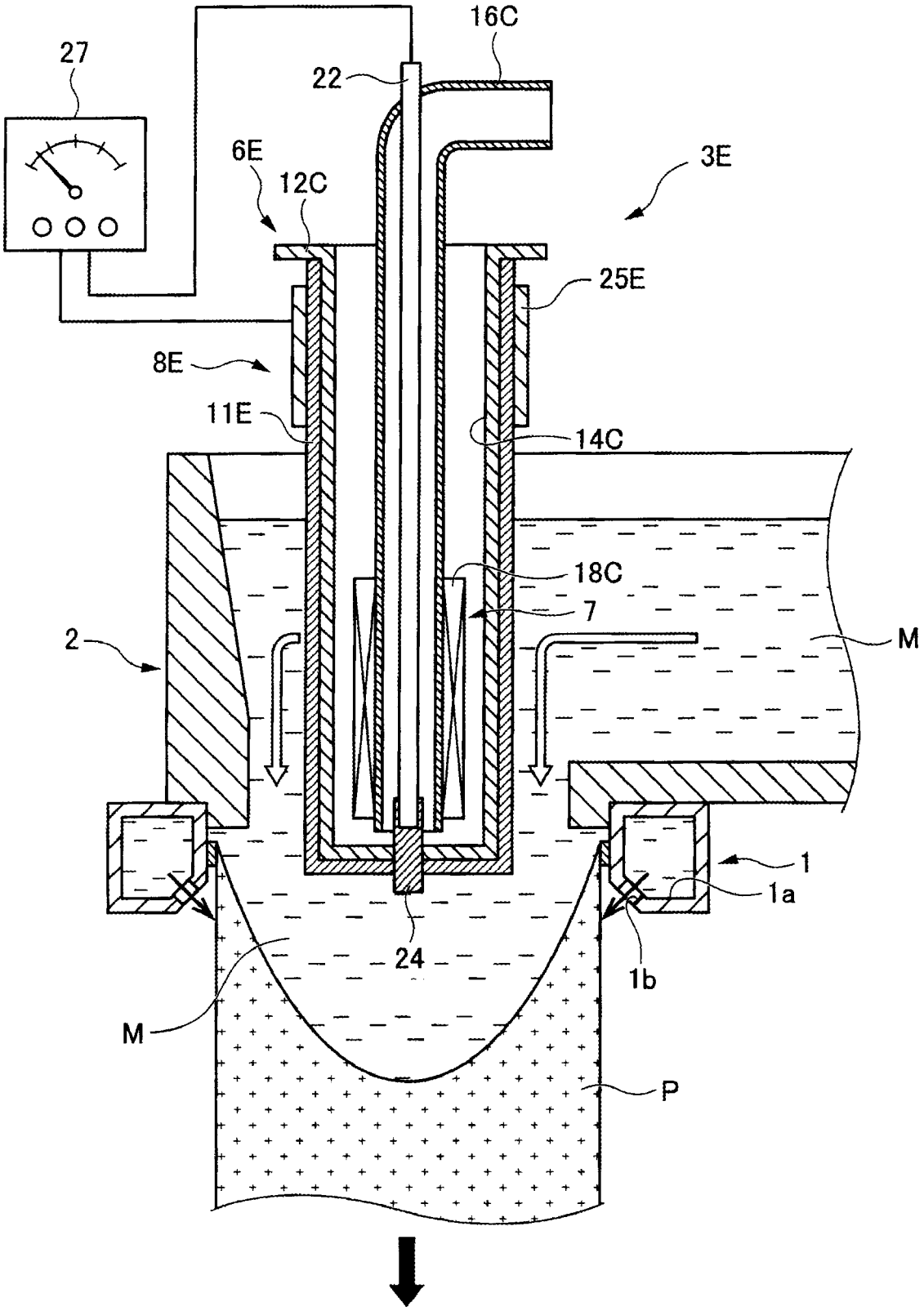
FIG. 13A is a partial longitudinal cross-sectional explanatory view of the entire configuration of a continuous casting device of an eighth embodiment corresponding to the embodiment of FIG. 12.

FIG. 13A illustrates an eighth embodiment of the present invention.

The eighth embodiment of the present invention exemplifies a configuration in which, as compared with the device illustrated in FIG. 13, a second electrode 25E of an electrode portion 8E of the molten metal stirring device 3E is provided at the top as in the embodiment of FIG. 2B, and an outer cylinder 11E in a case 6E is formed of a conductive material such as graphite. Others are substantially the same as the example of FIG. 2B, and therefore detailed description will be omitted.

According to each embodiment described above, the following advantages can be obtained.

(1) The stirring efficiency is extremely high because a molten metal is directly stirred.

(2) It is possible to respond efficiently also to a large-sized ingot.

(3) In the case of a large ingot, a plurality of molten metal stirring devices may be incorporated.

(4) The depth to the interface of the ingot in a mold varies depending on a drawing speed, size and the like of the product. In this case, the molten metal can be stirred more appropriately by adjusting the immersion depth of the molten metal stirring device into the crucible and the mold.

(5) The molten metal stirring device can be made compact, and thus, a large space is not required for installation.

(6) Thereby, the molten metal stirring device can be easily applied to the existing molding device and the like.

(7) The crystal structure of the product (ingot) can be refined.

(8) It is possible to make the crystal structure of the product (ingot) uniform.

(9) The production speed of the product can be increased. For example, the production speed can be increased about 10 to 30%.

(10) Since the molten metal is internally stirred, the quality of the product can be improved by preventing oxidation of the molten metal.

As described above, the continuous casting device of the embodiments of the present invention provides various advantages. Among the advantages, the improvement of the production speed (productivity) of the product will be further described below.

In general, in continuous casting, the productivity of a product depends on the drawing speed of the product. Productivity can be improved by increasing the drawing speed. However, if the drawing speed is increased beyond a certain rate, one or more longitudinally extending cracks may occur inside the product. The presence of the cracks can be confirmed, for example, by cutting the product after cooling and observing the inside of the product.

As described above, conventionally, even if it is intended to improve the productivity, there is a limit in increasing the drawing speed, and therefore, the productivity cannot be sufficiently improved.

However, according to the continuous casting device according the embodiments of the present invention, it is possible to obtain a high quality product having no crack therein even if the drawing speed is increased more than the speed in the conventional continuous casting device. Although this can be understood from the explanation described above, the present inventors have confirmed this by conducting experiments and actually manufacturing a prototype.

In addition, as a criterion for determining the quality of the product, there is a degree of refinement of the crystal structure. In other words, high-quality products are products in which the crystal structure is further refined. In order to refine the crystal structure, the molten metal may be quenched rapidly. That is, conversely, the crystal structure is not refined unless it is rapidly cooled.

In the process of continuous casting, in the upper part of the mold, a solid phase portion SP (refer to SP1 in FIG. 21 and the like) already solidified by the cooling of the molten metal, and a liquid phase portion LP (refer to LP1 in FIG. 21 and the like) to be solidified are present adjacent to each other to form an interface. Furthermore, at the interface between the two, a semi-solidified layer portion (Mushy Zone) MZ (refer to MZ1 in FIG. 21) having an intermediate property between a solid phase and a liquid phase appears.

The semi-solidified layer portion MZ is a transition layer in the process of transition from the liquid phase to the solid phase.

The present inventors have uniquely known by manufacturing a number of products and cutting and observing the products that when cooling is performed rapidly, this semi-solidified layer portion MZ becomes thin, and when cooling is performed gradually, it becomes thick. Therefore, it is said that conversely when the semi-solidified layer portion MZ is thin, the quality of the crystal structure in the solid phase portion SP is fine and excellent, and when it is thick, the quality of the crystal structure in the solid phase portion SP is rough and poor. In other words, from the thickness of the semi-solidified layer portion MZ, it can be understood whether the internal crystal structure of the product is fine good quality or coarse poor quality.

However, according to the continuous casting device of the embodiments of the present invention, the semi-solid phase portion MZ does not become thick even if the drawing speed is increased more than the speed in the conventional continuous casting device. This is because, although it has not been performed or has been originally impossible in the conventional continuous casting device, according to the continuous casting device of the embodiments of the present invention, the molten metal is supplied to the mold as a stirring state, and this makes it possible to stir the molten metal immediately before it solidifies in the mold. That is, according to the continuous casting device of the embodiments of the present invention, it is possible to obtain a good quality product even if the production efficiency is increased. This has been confirmed by the following experiments conducted by the present inventors.

(Experiment 1)

Outline of Experiment

The liquid phase portion LP and the semi-solidified layer portion MZ are then completely solidified, and only the solid phase portion SP is formed. In the experiment conducted by the present inventors, as can be confirmed visually, in the finally obtained prototype TP, the liquid phase portion LP and the semi-solidified layer portion MZ which appear only in the process of production, which originally disappears are made to appear. That is, although all prototypes TP are naturally obtained as solid (solid phase), when viewed at a moment in the manufacturing process, the prototype TP includes three solid portions including a first solid portion SP (MZ), which was once liquid phase portion LP, a second solid portion SP (MZ), which was once a semi-solidified layer portion MZ, and a the third solid portion SP (SP), which was once a solid. In this experiment, these three solid portions can be visually grasped in the prototype TP such that the quality of the prototype TP can be easily determined.

Figure 18:
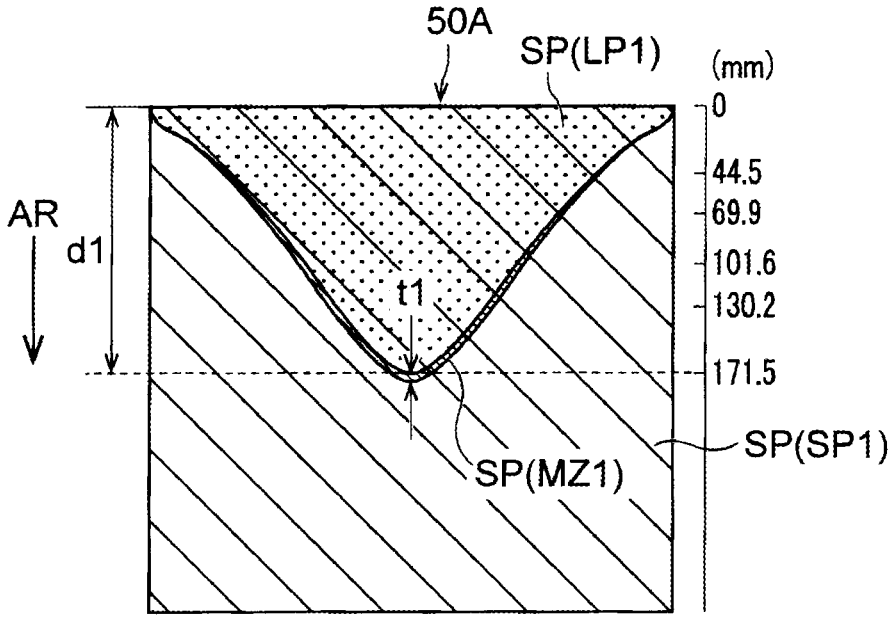
FIG. 18 is a longitudinal explanatory view illustrating a part of the prototype of FIG. 17.

That is, in general, all the finished products are solid phase portions SP, the liquid phase portion LP and the semi-solidified layer portion MZ disappear, and the liquid phase portion LP and the semi-solidified layer portion MZ cannot be visually identified. However, in this experiment, at a certain moment in the process of production, special treatment is applied to manufacture the finished product as a solid product (prototype), at the certain moment, as illustrated in FIG. 18, a portion that was once the liquid phase portion LP, a portion that was once the semi-solidified layer portion MZ, and a portion that was the solid phase portion SP.

Details of Experiment (1) A manufacturing experiment of a prototype (a cylindrical ingot of aluminum (round ingot)) will be described. The manufacturing experiment was conducted by the present inventor in order to confirm the improvement in productivity which is the effect of the continuous casting device of the present invention described above. In this manufacturing experiment, the continuous casting device of the embodiment of the present invention and the continuous casting device of the embodiments of the present invention from which the molten metal stirring device 3 is removed (continuous casting device before improvement) have been used.

Figure 17:
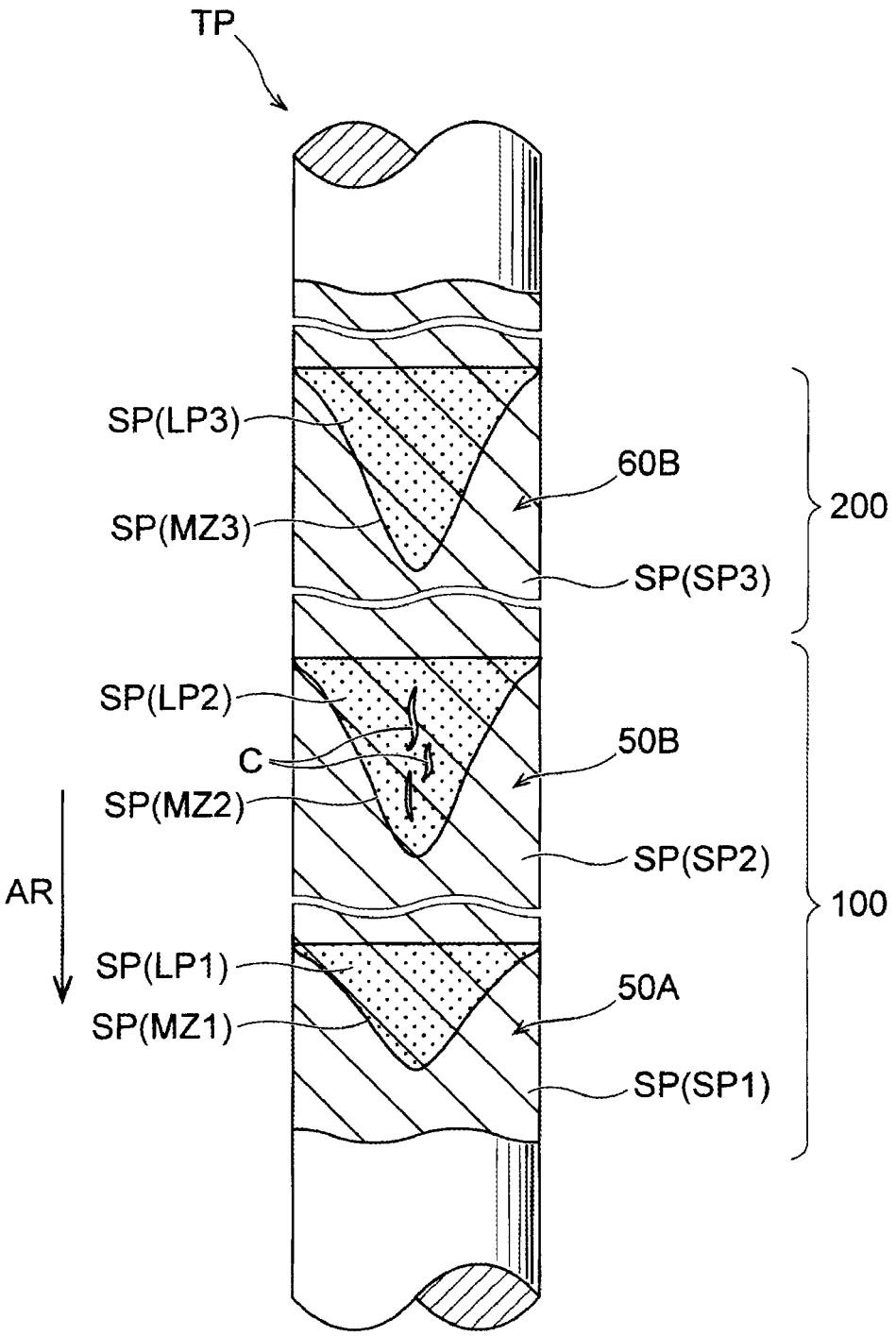
FIG. 17 is a partially longitudinal explanatory view of one continuous prototype obtained by switching the state in which the molten metal stirring device in FIG. 1 is removed and the state in which the molten metal stirring device is used as it is.

That is, when manufacturing the prototype TP using the continuous casting device of the embodiment of the present invention in FIG. 1, the present inventors have switched a state in which the molten metal stirring device 3 of FIG. 1 is removed (continuous casting device before improvement) and a state in which the molten metal stirring device 3 is used as it is (a continuous casting device according to the embodiment of the present invention) to produce one continuous prototype TP illustrated in FIG. 17. In FIG. 17, to facilitate understanding, a part of the prototype TP is broken (cut). That is, the inside of the prototype TP can be observed by longitudinally cutting after production. Now that, even if the continuous casting device according to the embodiment of the present invention illustrated in in FIGS. 4, 6, 12, 15 and 16 is used instead of the molten metal stirring device 3 illustrated in FIG. 1, it is obvious that the prototype TP similar to that of FIG. 17 can be obtained.

In the prototype TP illustrated in FIG. 17, a first prototype unit 100 is a portion manufactured by the continuous casting device before the improvement, and a second prototype unit 200 is a portion manufactured by the continuous casting device of the embodiment of the present invention. Furthermore, the first prototype unit 100 is provided with a slow low speed drawing portion 50A obtained by drawing at a low drawing speed (casting speed) in the direction of arrow AR and a first high speed drawing portion 50B obtained by drawing at a drawing speed (casting speed) faster than that. On the other hand, the second prototype unit 200 has a second high speed drawing portion 60B obtained by drawing at the same drawing speed (casting speed) as the first high speed drawing portion 50B.

As will be described later, as apparent from the comparison between the first high speed drawing portion 50B and the second high speed drawing portion 60B, the first high speed drawing portion 50B obtained by the continuous casting device before the improvement has a clack C. However, no cracks have been observed in the second high speed drawing portion 60B obtained by the continuous casting device of the present invention. That is, according to the experiment conducted by the present inventors, it has been confirmed that according to the continuous casting device of the present invention, even if the drawing speed (casting speed) is high, it is possible to obtain a cast product without cracks inside. That is, productivity could be improved in continuous casting.

(2) Hereinafter, details of the above-described manufacturing experiment will be described. As an experiment, an experiment A for obtaining the low speed drawing portion 50A in the first prototype unit 100, an experiment B for obtaining the first high speed drawing portion 50B, and an experiment C for obtaining the second high speed drawing portion 60B in the second prototype unit 200 have been carried out.

Figure 19:
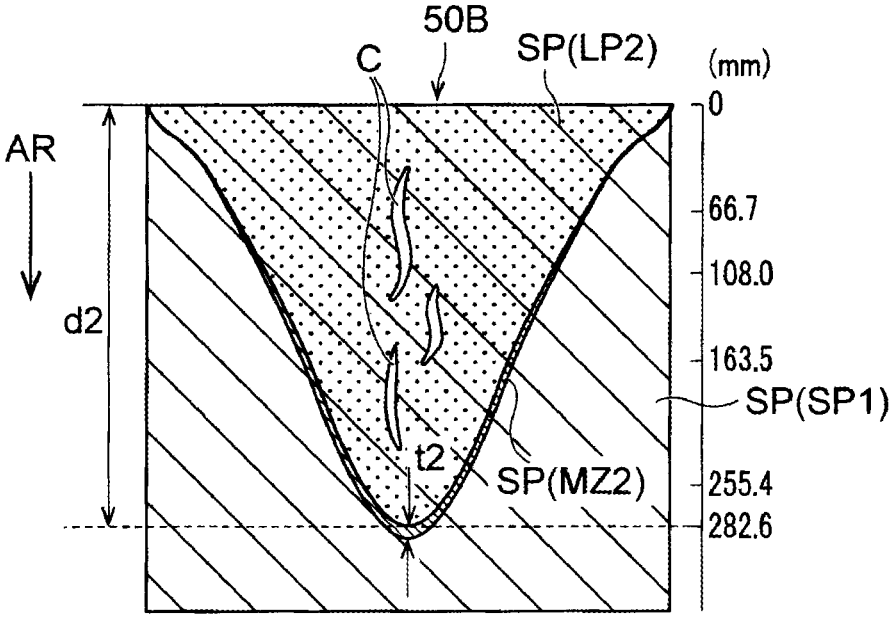
FIG. 19 is a longitudinal explanatory view illustrating a different part of the prototype of FIG. 17.
Figure 20:
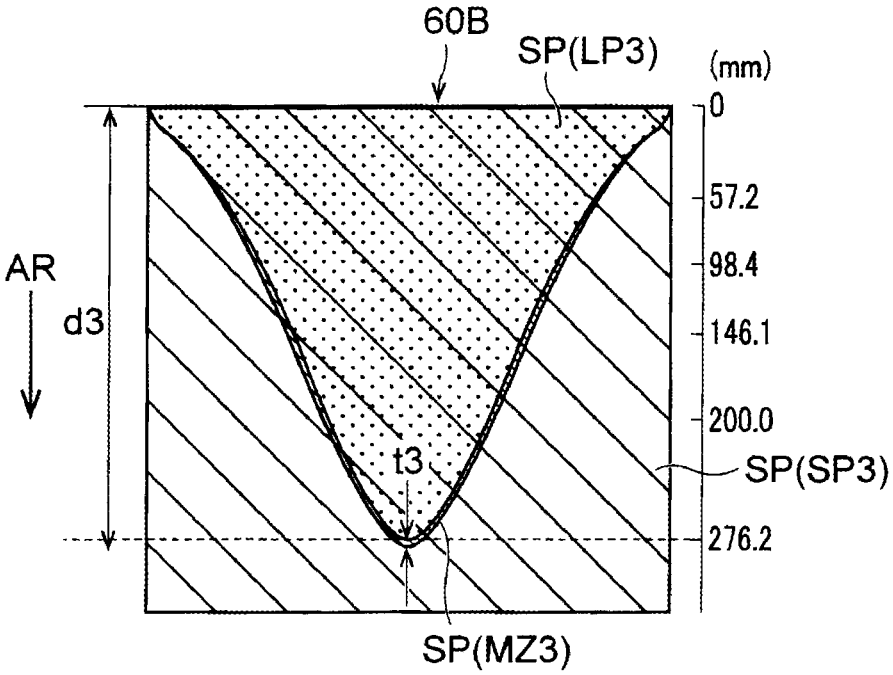
FIG. 20 is a longitudinal explanatory view illustrating a further different part of the prototype of FIG. 17.
Figure 21:
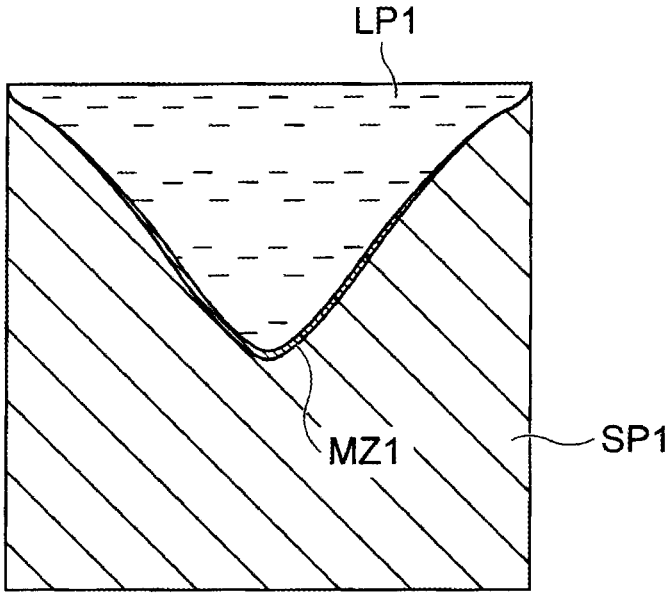
FIG. 21 is a longitudinal explanatory view illustrating a process of manufacturing a part of the prototype of FIG. 18.
Figure 22:
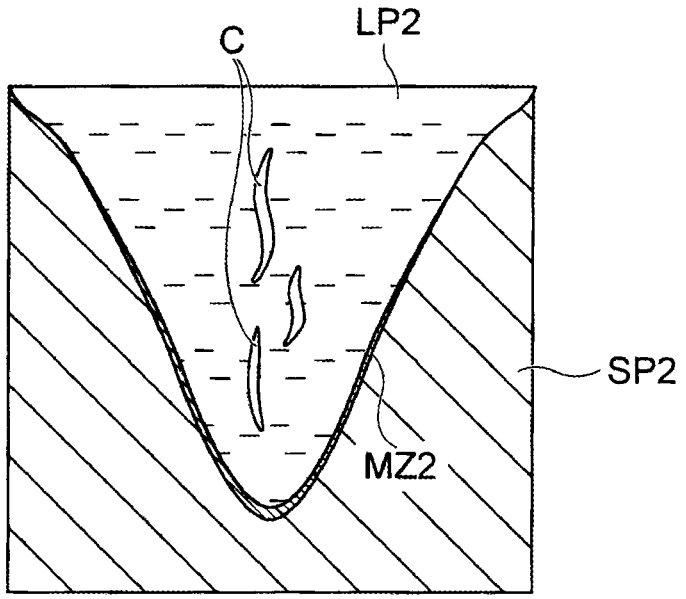
FIG. 22 is a longitudinal explanatory view illustrating a process of manufacturing a part of the prototype of FIG. 19.
Figure 23:
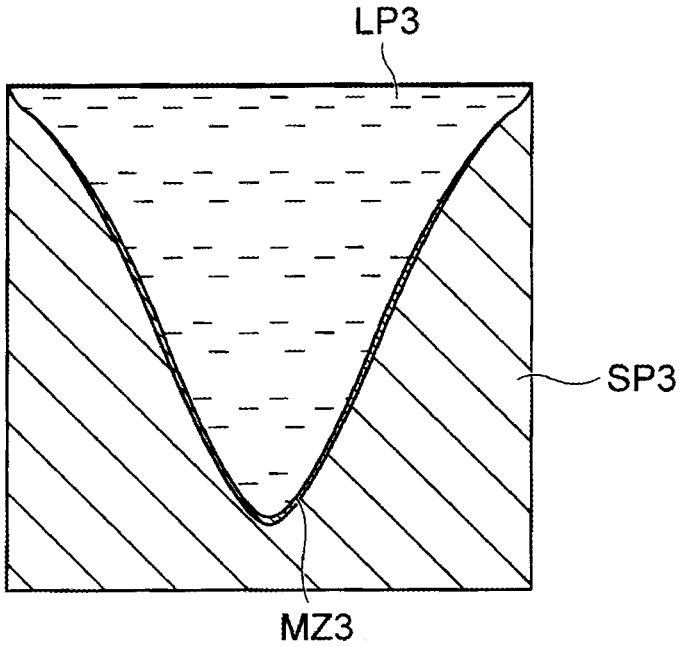
FIG. 23 is a longitudinal explanatory view illustrating a process of manufacturing a part of the prototype of FIG. 20.

The low speed drawing portion 50A, the first high speed drawing portion 50B, and the second high speed drawing portion 60B are obtained by the experiment A, the experiment B, and the experiment C, respectively. The low speed drawing portion 50A, the first high speed drawing portion 50B, and the second high speed drawing portion 60B are illustrated enlarged in FIGS. 18, 19, and 20, respectively. Note that, although each of FIGS. 18, 19, and 20 is a cross-sectional view of part of the prototype (solid) TP, from these FIGS. 18, 19, and 20, it is understood that the internal appearance of the mold 1 at each instant in the process of manufacturing by the continuous casting device is illustrated in FIGS. 21, 22, and 23 where three phases of solid, semi-solidified layer portion and liquid coexist. That is because the prototype (product) TP is obtained as it represents a certain moment in the manufacturing process. Therefore, hereinbelow, FIGS. 21, 22, and 23 will be described using an explanatory view illustrating the internal appearance of the mold at a certain moment in the product manufacturing process.

(2)-1 First, Experiments A and B for manufacturing the first prototype unit 100 (50A, 50B) illustrated in FIG. 17 will be described. Details of the low speed drawing portion 50A and the first high speed drawing portion 50B in the prototype TP are illustrated in FIGS. 18 and 19.

When the prototype unit 100 as a product (casting product) is manufactured by drawing with the continuous casting device before the improvement which removes the molten metal stirring device 3 from the continuous casting device of FIG. 1, the drawing speed (casting speed) is first made low and then switched to high. In other words, the initial low speed drawing results in the low speed drawing portion 50A of FIG. 17, and the high speed drawing thereafter results in the first high speed drawing portion 50B.

Condition 1 (experiment A) at the time of the low speed drawing and condition 2 (experiment B) at the time of the high speed drawing are as follows. Further, as indicated in FIGS. 21 and 22 indicating respective moments in the manufacturing process, the sump depths (maximum depth of the liquid phase portion LP) d1 and d2 and the thicknesses t1 and t2 of the semi-solidified layer portion (Mushy Zone) MZ, appearing in the cases of the conditions 1 and 2 are as follows from FIGS. 18 and 19 illustrating the prototype TP.

(Experiment A) (Condition 1 and Results)
Material: Aluminum
Additives: Zinc
Diameter of round ingot $\phi$=355 mm
Drawing speed (casting speed) v1=75 mm/min
Sump depth (maximum depth of liquid phase portion LP) (FIG. 21) d1=171.5 mm
Thickness of semi-solidified layer portion (Mushy Zone) (FIG. 21) t1=4 mm That is, drawing is performed at low speed under the above condition 1 by the continuous casting device before the improvement. Zinc is added to the liquid phase portion LP1 at a certain moment when the drawing under the condition 1 is performed. The added zinc instantaneously diffuse into aluminum of the liquid phase portion LP1 to form an alloy and act as a contrast agent. Drawing is performed under the above condition 1 for a predetermined time after the addition. By this experiment A, the low speed drawing portion 50A of FIGS. 17 and 18 is obtained. The mechanism by which this low speed drawing portion 50A is obtained will be described later.

It can be seen from FIG. 21 that the internal state of the mold 1 in the experiment A under the condition 1 is as follows. That is, FIG. 21 indicates the case when viewed from a vertical cross section of the top of the product in the mold 1 at a certain moment. In FIG. 21, the solid phase portion SP1 which has been solidified already appears on the lower side, and the liquid phase portion LP1 to be solidified appears on the upper side. Furthermore, a semi-solid phase portion (Mushy Zone) MZ1 appears at the interface between the two phases. As illustrated in FIG. 21, the sump depth (the maximum depth of the liquid phase portion LP1) d1=171.5 mm, and the thickness t1 of the semi-solid phase portion (Mushy Zone) MZ1 is 4 mm. As can be seen from FIG. 21, when the drawing speed (casting speed) is low, generation of cracks (voids) is not observed in the liquid phase portion LP1. Along with this, finally, as can be seen from the prototype TP illustrated in FIG. 17, the low speed drawing portion 50A free of cracks is formed.

(Experiment B) (Condition 2 and Results)
Material: Aluminum
Additives: Zinc
Diameter of round ingot D=355 mm
Drawing speed (casting speed) v2=109 mm/min
Sump depth (maximum depth of liquid phase portion LP) (FIG. 22) d2=282.2 mm
Thickness of semi-solidified layer portion (Mushy Zone) (FIG. 22) t2=5.5 mm Following the drawing under the above condition 1 performed by the continuous casting device before improvement, similarly, drawing is performed at a higher speed than before under the above condition 2 by the continuous casting device before the improvement. As described above, zinc is added to the liquid phase portion LP2 at a certain moment when the drawing under the condition 2 is performed. Similar to the above, the added zinc diffuses at high speed into aluminum of the liquid phase portion LP2, forms an alloy, and serves as a contrast agent. By this experiment B, the first high speed drawing portion 50B of FIGS. 17 and 22 is obtained. The mechanism by which the first high speed drawing portion 50B is obtained will be described later.

In the experiment B under the condition 2, the longitudinal cross section of the top of the mold 1 is as indicated in FIG. 22. In FIG. 22, the solid phase portion SP2 which has been solidified already appears on the lower side, and the liquid phase portion LP2 to be solidified appears on the upper side. Furthermore, a semi-solid phase portion (Mushy Zone) MZ2 appears at the interface between the two phases. As illustrated in FIG. 22, the sump depth (maximum depth of the liquid phase portion LP) d2=282.2 mm, and the thickness t2 of the semi-solidified layer portion (Mushy Zone) MZ2=5.5 mm. As can be seen from FIG. 22, when the drawing speed (casting speed) is high, generation of cracks (voids) is observed in the liquid phase portion LP2. Along with this, the first high speed drawing portion 50B including the crack illustrated in FIG. 17 is formed.

(2)-2 Next, the experiment C for manufacturing the second prototype unit 200 of FIG. 17 will be described.

The drawing speed (casting speed) at the time of manufacturing a prototype 200 as a product (casting product) by drawing using the continuous casting device of the present invention of FIG. 1 is the same high drawing speed (casting speed) as in the manufacturing of the first high speed drawing portion 50B in the first prototype unit 100. As a result, the second high speed drawing portion 60B of FIG. 17 can be obtained.

The condition 3 (experiment C) at the time of the high speed drawing is as follows. Further, the sump depth (maximum depth of the liquid phase portion LP) d3 and the thickness t3 of the semi-solidified layer portion (Mushy Zone) appearing under the condition 3 are as follows.

(Experiment C) (Condition 3 and Results)
Material: Aluminum
Additives: Zinc
Diameter of round ingot $\phi$=355 mm
Drawing speed (casting speed) v3=102 mm/min Sump depth (maximum depth of liquid phase portion LP) (FIG. 23) d3=276.2 mm Thickness of semi-solidified layer portion (Mushy Zone) (FIG. 23) t3=4 mm The drawing under the condition 3 is performed by the continuous casting device of the present invention. At an instant when drawing under this condition 3 is performed, zinc is added to the liquid phase portion LP3 as described above. Similar to the above, the added zinc diffuses at a high speed into aluminum of the liquid phase portion LP to form a certain alloy, and serves as a contrast agent. This experiment C resulted in the second high speed drawing portion 60A of FIGS. 17 and 20. The mechanism by which this second high speed drawing portion 50B is obtained will be described later.

The process of the experiment C under the condition 3 is indicated in FIG. 23. In FIG. 23, the solid phase portion SP3 which has been solidified already appears on the lower side, and the liquid phase portion LP3 to be solidified appears on the upper side. Furthermore, a semi-solid phase portion (Mushy Zone) MZ3 appears at the interface between the two phases. As illustrated in FIG. 23, the sump depth (the maximum depth of the liquid phase portion LP3) d3 is 276.2 mm, and the thickness t3 of the semi-solidified phase portion (Mushy Zone) MZ3 is 4 mm. Further, as can be seen from FIG. 23, although the drawing speed (casting speed) is high, generation of cracks (voids) is not observed in the liquid phase portion LP3. That is, when the product is manufactured under this condition 3, although the sump depth is increased compared to the case of the above condition 1 in which no crack occurs, the thickness of the semi-solid phase portion (Mushy Zone) MZ3 hardly increased. Since the semi-solid phase portion (Mushy Zone) MZ3 does not become thick, even if high-speed drawing casting is performed by the device of the present invention, it can be expected that the heat transfer in the material can be accelerated to improve the productivity while maintaining the uniformity and refinement of the crystal structure and the mechanical strength of the product. In fact, as illustrated in FIG. 20, it is possible to form the low speed drawing portion 60A without cracks.

As can be seen from the above description, according to the continuous casting device of the present invention, it is about 30% as compared to the continuous casting device before improvement, and the drawing speed of the product can be increased.

Further, the purpose, summary and further experiments of the present invention will be described below.

In general, metal products of various ingots such as round rods or prisms are obtained through the steps of melting the raw material metal, adjusting its components, and solidifying it into a predetermined shape. At this time, the quality of the final product, for example, the mechanical properties, the homogenization of the crystal structure, the refinement, etc., is determined by the state in the sump during solidification (the unsolidified liquid portion at the top of the product during continuous casting).

Solidification of the molten metal is caused by heat transfer, but the heat conduction in the solid is twice that of the liquid, therefore the molten metal in the container or in the mold for continuous casting solidifies from the outer peripheral portion toward the center. In the case of continuous casting, for example, as can be seen from FIG. 1, solidification proceeds with the liquid and solid coexisting in the top portion of the product.

An important point to improve the quality of the product is to reduce, for example, the liquid portion and semi-solidified layer portion as much as possible in FIG. 1, but because the thermal conductivity of liquid and solid is different, it is significantly difficult to achieve such purpose.

Therefore, the present inventor has focused on that the thermal conductivity of liquid is lower than that of solid, and by applying a magnetic field and a current to a molten metal and stirring, even if the sump depth increases by increasing the drawing speed (casting speed), no cracks occur.

Now that, according to the present invention, particularly, the case of improving the cooling rate to improve the quality, the case where the present invention is applied to continuous casting of various ingots (round ingots (round rod-like ingots) or prismatic ingots) will be described.

In the continuous casting process, for example, as can be seen from FIG. 1, a downward convex conical pillar (a downward convex parabolic shape in the longitudinal cross section) sump always appears.

Now that heat transfer can be explained by Newton's law of cooling.

That is, assuming that the amount of a heat transfer Q, a time t, a surface area S, a high temperature side temperature TH, a low temperature side temperature TL, and a temperature coefficient α, $$-dQ/dt=\alpha\cdot S(TH-TL) \text{ holds.}$$

That is, heat transfer is smoothly performed as the temperature gradient proportional to the difference between the high temperature side temperature TH and the low temperature side temperature TL is large.

Although heat transfer increases by stirring, the difference in temperature difference between the presence and absence of stirring is considered.

Figure 24:
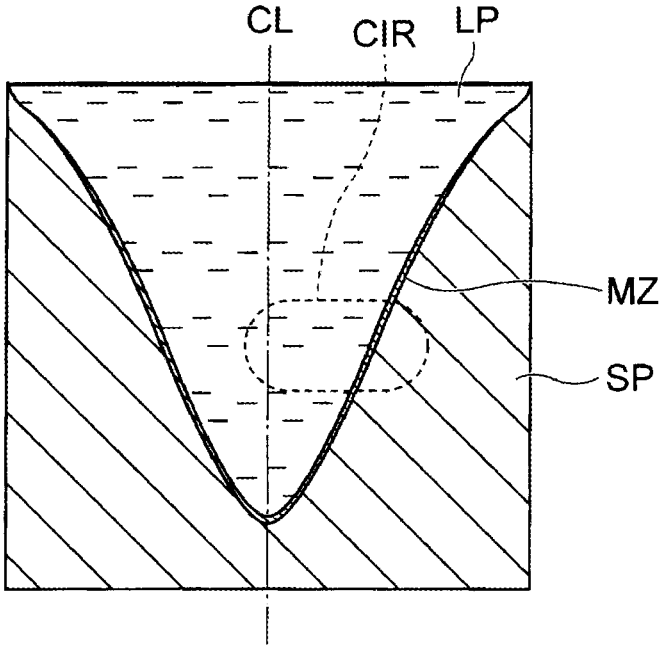
FIG. 24 is a longitudinal explanatory view illustrating a process of manufacturing a prototype for explaining a further different experiment.

FIG. 24 is a longitudinal sectional view at a certain point in a process of changing molten metal (liquid) into a product (solid) inside a mold in general continuous casting.

Figure 25:
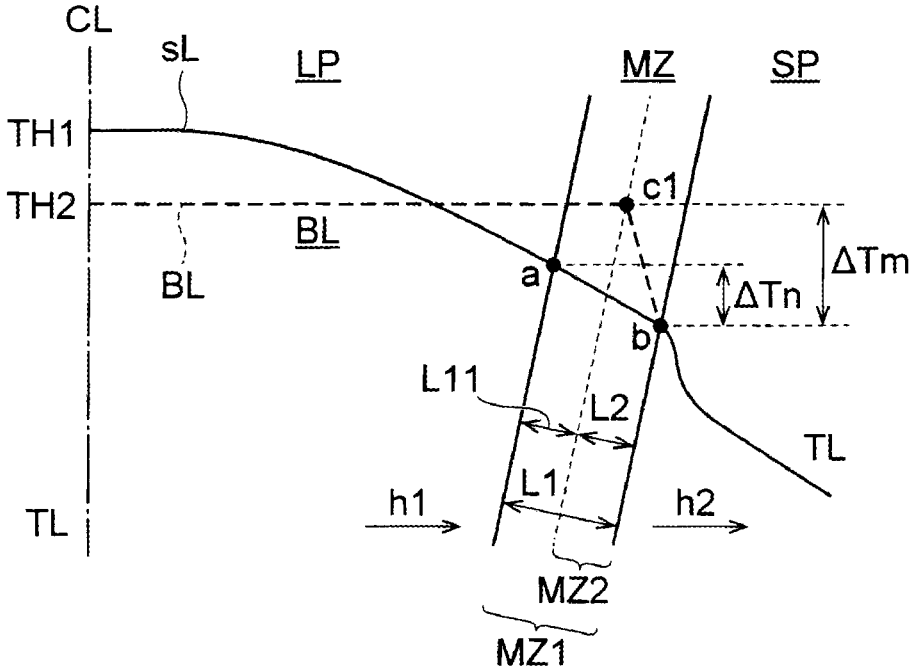
FIG. 25 is a temperature distribution explanatory view indicating temperature distributions of a molten metal (liquid), a semi-solidified layer portion, and a prototype (solid) in the manufacturing process of FIG. 24.

FIG. 25 indicates a state of heat of a portion surrounded by the elongated circle CIR in FIG. 24. The solid line SL indicating the temperature indicates a case of continuous casting without stirring, and the broken line BL indicates a case of stirring according to the present invention. Repeatedly, the solid line SL indicates the temperature distribution when the molten metal is not stirred, and the broken line BL indicates the temperature distribution when the molten metal is stirred. However, the outer side (right side in the drawing) of a point b described later of the solid line SL indicates a common temperature distribution in the two cases with and without stirring. Further, when not stirred, the semi-solidified layer portion MZ becomes the semi-solidified layer portion MZ1 (thickness L1), and when stirred, it becomes the semi-solidified layer portion MZ2 thinner than the semi-solidified layer portion MZ1 (thickness L2=L1−L11). Further, as illustrated in FIG. 25, as described later, the temperature difference between the inside point a of the semi-solidified layer portion MZ1 and the outside point b is ΔTn, and the temperature difference between the point c on the inner surface of the semi-solidified layer portion MZ2 and the point b on the outer surface is ΔTm.

That is, when stirring is not performed, as can be seen from the solid line SL, the portion of the center line CL indicates the highest temperature TH1, and the temperature gradually decreases toward the outer periphery and decreases to the temperature of the point a on the boundary between the liquid portion LP and the semi-solidified layer portion MZ1. Inside the semi-solidified layer portion MZ, the cooling rate is faster than the liquid portion LP and decreases to the temperature of the point b on the boundary between the semi-solidified layer portion MZ1 and the solid portion SP. In the solid portion SP, the temperature drops rapidly and reaches the temperature TL in FIG. 25.

On the other hand, when stirring is performed, the temperature distribution inside the liquid (molten metal) is almost uniform as seen from the broken line BL. Therefore, almost no temperature gradient occurs from the center line CL to the inside of the semi-solidified layer portion MZ2. That is, in this case, the temperature of the center line CL portion is also the temperature TH2 lower than the previous temperature TH1. Thus, as described above, the thickness L2 of the semi-solidified layer portion MZ2 becomes thinner by the thickness T11 than the thickness T1 by the stirring. This temperature TH2 continues to the point c inside the semi-solidified layer portion MZ2. In the semi-solidified layer portion MZ2, the temperature drops from the point c to the point b. After this, as in the case of no stirring, the temperature TL is obtained.

Here, when viewed at the semi-solidified layer portion MZ, the thickness is the thickness L1 without stirring, and the thickness L2 (=L1−L11) with stirring. That is, the thickness is L1>L2. Further, the temperature difference between the inner surface and the outer surface of the semi-solidified layer portion MZ is the temperature difference ΔTn without stirring, and the temperature difference ΔTm with stirring. Therefore, when the temperature gradients without stirring and with stirring are compared, ΔTn/L1<ΔTm/L2 is obtained. If this is compared with Newton's law of cooling, it can be seen that the cooling rate is overwhelmingly fast in the case of cooling.

In consideration of the quality of various ingots (round bar, prism, etc.), it is desirable that the temperature distribution of the liquid portion LP be uniform, and it is desirable that the cooling be performed at once in a high speed.

That is, in the present invention, by forcibly stirring the liquid phase portion LP on the top of the product, which appears during continuous casting, rather than cooling by natural cooling, the temperature difference between the central part and the peripheral part of the liquid phase portion LP is made as small as possible, and the semi-solidified layer portion MZ is made to be thin and to be cooled. As a result, according to the present invention, it is found that productivity can be greatly improved while achieving uniformization and miniaturization of crystals, and improvement of mechanical characteristics, that is, improvement of product quality.

Figure 26:
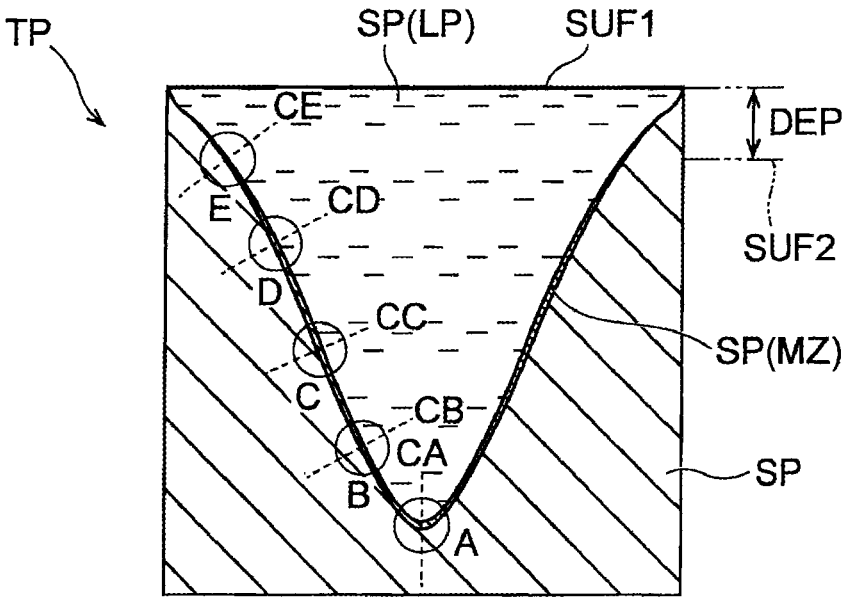
FIG. 26 is a longitudinal explanatory view indicating a positional relationship of a sample (first test piece) taken out from the prototype corresponding to FIG. 24.

Furthermore, in order to obtain a cylindrical ingot as a prototype TP for continuous casting, zinc (Zn) is introduced into the sump as a chemical tracer. The solidified version of the prototype is illustrated in FIG. 26. In the drawing, when the above Zn is introduced, the liquid portion is SP (LP), the semi-solidified layer portion is SP (MZ), and the solid portion is SP.

From this prototype TP, the five first test pieces (cylinders) of A to E are hollowed out from the part of which position is indicated in FIG. 26. That is, from the prototype TP, five first test pieces A to E are hollowed out in the direction perpendicular to the paper surface of FIG. 26. Further, as can be seen from FIG. 27, five measurement points (measurement points MP1 to MP5) are defined for each of the first test pieces A to E, and five more second test pieces are hollowed out in the direction perpendicular to the paper surface from those measurement points. That is, five second test pieces A1 to A5 are obtained from the first test piece A, and five second test pieces B1 to B5 are obtained also from the first test piece B. Similarly, five second test pieces C1 to C5, D1 to D5 and E1 to D5 were obtained from the first test pieces C, D and E, respectively. This gave twenty five second test pieces.

Figure 27:
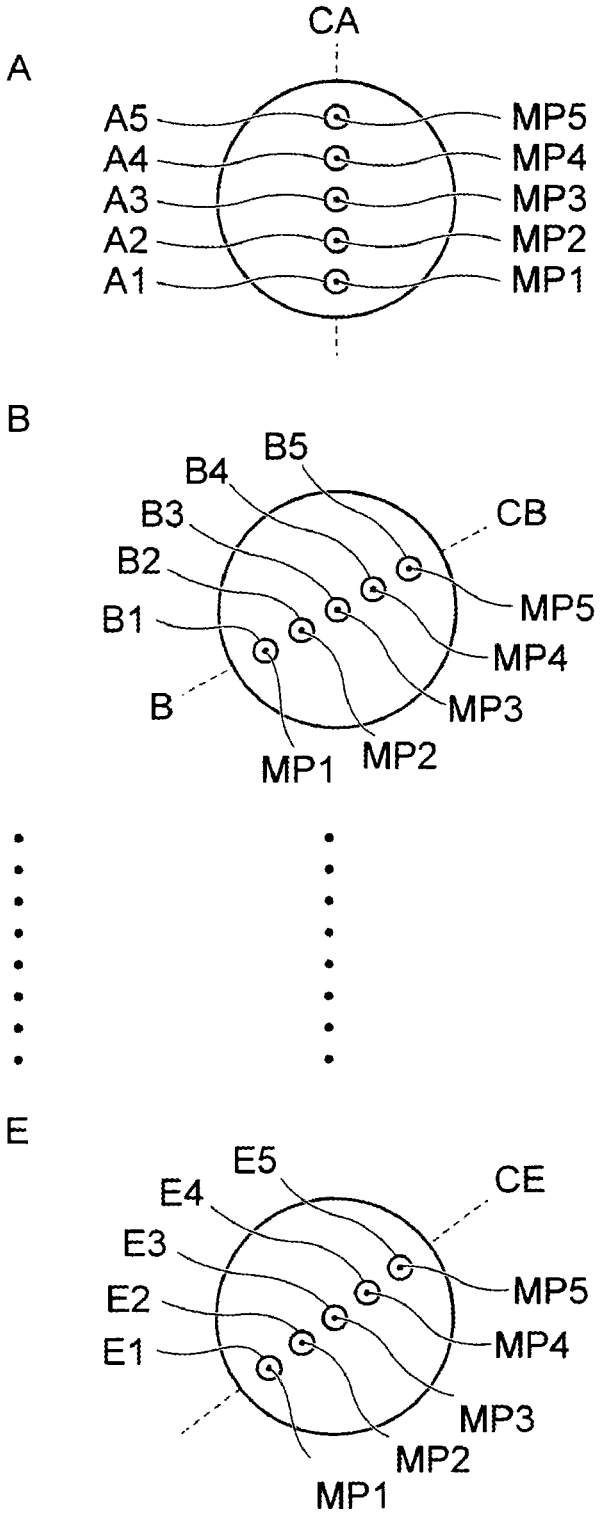
FIG. 27 is a longitudinal explanatory view indicating a positional relationship in each sample (first test piece) of a sample (second test piece) further taken out from each sample (first test piece) taken out.

The directions of the center lines CA, CB, . . . of the second test pieces A1 to A5, B1 to B5, . . . in the first test pieces A to E in FIG. 27 are indicated in FIG. 26. That is, as can be seen from FIG. 26, the center lines CA, CB, . . . are oriented along the thickness direction of the portion SP (MZ) which was once the semi-solidified layer portion MZ.

The concentration of zinc as the chemical tracer in the above-described twenty five second test pieces A1 to A5, B1 to B5, . . . is measured, and the concentrations CA1 to CA5, CB1 to CB5, . . . CE1 to CE5 are obtained. Further, the average values a1, a2, . . . a5 of the concentrations of zinc at the measurement points MP1 to MP5 of the first test pieces A to E are determined from the following equations.

$$a1 = (CA1 + CB1 + CC1 + CD1 + CE1)/5$$
$$a2 = (CA2 + CB2 + CC2 + CD2 + CE2)/5$$
$$\vdots$$
$$a5 = (CA5 + CB5 + CC5 + CD5 + CE5)/5$$

That is, the average values a1, a2, . . . of the concentrations of zinc at the measurement points MP1 to MP5 are obtained from the above equation.

Figure 28:
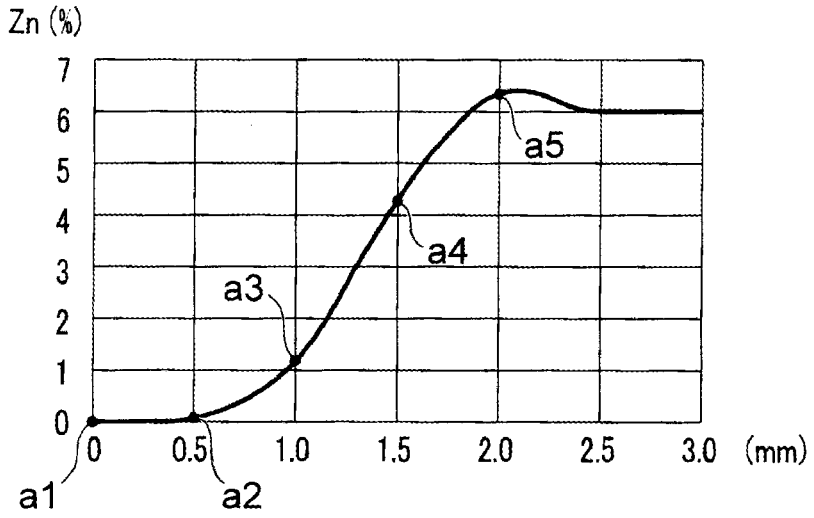
FIG. 28 is a graph indicating a zinc concentration of the sample (second test piece) taken out.

The mean values a1, a2, . . . a5 of the concentration of zinc are plotted in FIG. 28. From FIG. 28, it is found that the thickness of the semi-solidified layer portion MZ is about 2 mm.

Such an experiment is repeated to create a plurality of graphs corresponding to FIG. 28. That is, in the continuous casting, the drawing speed (casting speed) is variously changed, and a plurality of graphs corresponding to FIG. 28 is obtained from the prototype TP obtained at that time. Most of these graphs are obtained as illustrated in FIG. 28. That is, when the product is obtained while stirring the molten metal according to the embodiment of the present invention, the thickness of the semi-solidified layer portion MZ does not increase. That is, according to the device of the embodiment of the present invention, the quality of the product does not deteriorate even if the drawing speed (casting speed) of the product is increased.

In addition, an observation end face SUF2 obtained by performing CMP on the end face lowered by DEP (7 inches) from the end face SUFI of the prototype TP cut out as indicated in FIG. 26 is observed with an SEM. This observation is performed on the prototype TP obtained by variously changing the drawing speed (casting speed). As a result, it is observed that in the prototype TP obtained by stirring the molten metal by the device of the embodiment of the present invention, the crystal structure did not become rough even if the drawing speed (casting speed) is increased.

The invention claimed is:

1. A molten metal stirring device configured to stir, in a continuous casting device that continuously molds products by pouring a molten metal of a conductive metal into a mold, a molten metal to be poured into the mold or a molten metal in the mold, the molten metal stirring device, comprising an outer cylinder to be immersed in the molten metal, an inner cylinder housed in the outer cylinder with a gap, a magnetic field device housed inside the inner cylinder, a first electrode electrically connected to a power supply panel and a second electrode electrically connected to the power supply panel, wherein in the magnetic field device, magnetic lines of force from the magnetic field device penetrate the inner cylinder and the outer cylinder to reach the molten metal, or the magnetic lines of force running in the molten metal are magnetized to penetrate the inner cylinder and the outer cylinder to reach the magnetic field device, the first electrode penetrates the inner cylinder and the outer cylinder, one end of the first electrode is exposed in the inner cylinder, and an other end of the first electrode is exposed to the outside of the outer cylinder to be in contact with the molten metal, the one end of the first electrode is electrically connected to a first polarity terminal of the power supply panel, and the second electrode is electrically connected to a second polarity terminal of the power supply panel and provided at a position where the current supplied from the power supply panel and flowing through the molten metal between the second electrode and the first electrode crosses the magnetic lines of force to generate a Lorentz force that rotationally drives the molten metal about a longitudinal axis.

2. The molten metal stirring device according to claim 1, wherein the first electrode is attached to the outer cylinder and the inner cylinder in a state of penetrating a bottom plate of the inner cylinder and a bottom plate of the outer cylinder, and the second electrode is attached to a position higher than the magnetic field device on an outer peripheral surface of the outer cylinder.

3. The molten metal stirring device according to claim 1, wherein the magnetic field device is magnetized so as to emit or receive magnetic lines of force along lateral lines or along downward lines.

4. The molten metal stirring device according to claim 1, wherein the magnetic field device is magnetized so as to emit or receive magnetic lines of force along lateral lines and along downward lines.

5. The molten metal stirring device according to claim 4, wherein, in the magnetic field device, a magnet magnetized to emit or receive magnetic lines of force along the lateral lines and a magnet magnetized to emit or receive magnetic lines of force along the downward lines are stacked vertically.

6. The molten metal stirring device according to claim 1, wherein the outer cylinder is formed with a non-conductive material.

7. The molten metal stirring device according to claim 1, wherein the second electrode is attached on an outer peripheral surface of the outer cylinder, and the outer cylinder is formed with a conductive material which generates heat by energization.

8. A continuous casting device system, comprising: the molten metal stirring device according to claim 1, a trough for guiding molten metal from a furnace, and a mold attached to a bottom surface of the trough in communication with a molten metal inlet, wherein the molten metal stirring device is incorporated in a state in which a lower end side of the molten metal stirring device is inserted into a molten metal discharge passage in the trough.

9. The continuous casting device system according to claim 8, wherein the molten metal stirring device is configured to adjust an insertion amount of the lower end side of the molten metal stirring device into the molten metal discharge passage of the trough with respect to the trough.

10. A molten metal stirring device configured to stir, in a continuous casting device that continuously molds products by pouring a molten metal of a conductive metal into a mold, a molten metal to be poured into the mold or a molten metal in the mold, the molten metal stirring device, comprising a cylindrical case to be immersed in the molten metal, a magnetic field device housed inside the cylindrical case, a first electrode electrically connected to a power supply panel and a second electrode electrically connected to the power supply panel, wherein in the magnetic field device, magnetic lines of force from the magnetic field device penetrate the case to reach the molten metal, or the magnetic lines of force running in the molten metal are magnetized to penetrate the case to reach the magnetic field device, the first electrode penetrates the case, one end of the first electrode is exposed to the inside of the case, and an other end of the first electrode is exposed to the outside of the case to be in contact with the molten metal, the one end of the first electrode is electrically connected to a first polarity terminal of the power supply panel, and the second electrode is electrically connected to a second polarity terminal of the power supply panel and provided at a position where the current supplied from the power supply panel and flowing through the molten metal between the second electrode and the first electrode crosses the magnetic lines of force to generate a Lorentz force that rotationally drives the molten metal about a longitudinal axis.

11. The molten metal stirring device, according to claim 10, wherein the first electrode is attached to the case in a state of penetrating a bottom plate of the case, and the second electrode is attached to a position higher than the magnetic field device on an outer peripheral surface of the case.

12. The molten metal stirring device according to claim 10, wherein the magnetic field device is magnetized so as to emit or receive magnetic lines of force along lateral lines or along downward lines.

13. The molten metal stirring device according to claim 10, wherein the magnetic field device is magnetized so as to emit or receive magnetic lines of force along lateral lines and along downward lines.

14. The molten metal stirring device according to claim 13, wherein, in the magnetic field device, a magnet magnetized to emit or receive magnetic lines of force along the lateral lines and a magnet magnetized to emit or receive magnetic lines of force along the downward lines are stacked vertically.

15. The molten metal stirring device according to claim 10, wherein the case is formed with a non-conductive material.

16. The molten metal stirring device according to claim 10, wherein the second electrode is attached on an outer peripheral surface of the case, and the case is formed with a conductive material which generates heat by energization.

17. A continuous casting device system, comprising: the molten metal stirring device according to claim 10, a trough for guiding molten metal from a furnace, and a mold attached to a bottom surface of the trough in communication with a molten metal inlet, wherein the molten metal stirring device is incorporated in a state in which a lower end side of the molten metal stirring device is inserted into a molten metal discharge passage in the trough.

18. The continuous casting device system according to claim 17, wherein the molten metal stirring device is configured to adjust an insertion amount of the lower end side of the molten metal stirring device into the molten metal discharge passage of the trough with respect to the trough.

* * * * *